US005601464A

United States Patent [19]

Ogino et al.

[11] Patent Number: 5,601,464

[45] Date of Patent: Feb. 11, 1997

[54] TRANSMISSION SYSTEM FOR COUNTER-ROTATIONAL PROPULSION DEVICE

[75] Inventors: Hiroshi Ogino; Yoshikazu Nakayasu, both of Hamamatsu, Japan

[73] Assignee: Sanshin Kogyo Kabushiki Kaisha, Hamamatsu, Japan

[21] Appl. No.: 347,286

[22] Filed: Nov. 30, 1994

[30] Foreign Application Priority Data

Nov. 30, 1993 [JP] Japan ..... 5-300234

[51] Int. Cl.[6] ..... B63H 21/28

[52] U.S. Cl. ..... 440/75; 440/900; 440/80

[58] Field of Search ..... 475/207, 206, 475/198, 332, 343; 440/900, 79–81, 83, 75; 416/129 A, 29 R, 128

[56] References Cited

U.S. PATENT DOCUMENTS

| | | | |
|---|---|---|---|
| 537,612 | 4/1895 | Leathers | 440/81 |
| 599,125 | 2/1898 | Fefel | 440/81 |
| 624,674 | 5/1899 | Painton | 440/80 |
| 938,911 | 11/1909 | Taylor | 440/81 |
| 1,381,939 | 6/1921 | Small | 440/80 |
| 1,434,620 | 11/1922 | McCain | 440/80 |
| 1,807,254 | 5/1931 | Piano | 440/80 |
| 1,813,552 | 7/1931 | Stechauner | 440/81 |
| 1,853,694 | 4/1932 | Melcher | 440/81 |
| 1,879,142 | 9/1932 | Egan | 440/80 |
| 1,992,333 | 2/1935 | Stelzer | 440/81 |
| 2,058,361 | 10/1936 | Sherwood | 440/81 |
| 2,062,293 | 12/1936 | Cashman | 440/79 |
| 2,064,195 | 12/1936 | De Michelis | 440/80 |
| 2,170,733 | 8/1939 | Sharpe . | |
| 2,228,638 | 1/1941 | Mercier | 440/75 |
| 2,285,592 | 6/1942 | Ledwinka | 440/75 |
| 2,347,906 | 5/1944 | Hatcher | 440/81 |
| 2,372,247 | 3/1945 | Billing | 440/80 |
| 2,672,115 | 3/1954 | Conover | 440/81 |
| 2,987,031 | 6/1961 | Odden | 115/37 |
| 2,989,022 | 6/1961 | Lundquist | 74/665 |
| 3,478,620 | 11/1969 | Shimanckas | 115/34 R |
| 3,727,574 | 4/1973 | Bagge | 115/35 |
| 3,769,930 | 11/1973 | Pinkerton | 115/900 |
| 4,153,002 | 5/1979 | Sigg | 60/39.75 |
| 4,251,987 | 2/1981 | Adamson | 440/66 |
| 4,529,387 | 7/1985 | Brandt | 440/81 |
| 4,540,369 | 9/1985 | Caires | 416/129 |
| 4,619,584 | 10/1986 | Brandt | 440/75 |
| 4,642,059 | 2/1987 | Nohara | 440/75 |
| 4,741,670 | 5/1988 | Brandt | 416/129 |
| 4,767,269 | 8/1988 | Brandt | 416/124 |
| 4,790,782 | 12/1988 | McCormick | 440/81 |
| 4,792,314 | 12/1988 | McCormick | 440/81 |
| 4,793,773 | 12/1988 | Kinouchi et al. | 416/129 |
| 4,795,382 | 1/1989 | McCormick | 440/81 |
| 4,823,636 | 5/1989 | McCormick | 440/80 |
| 4,828,518 | 5/1989 | Kouda et al. | 440/50 |
| 4,832,570 | 5/1989 | Solia | 416/93 A |
| 4,840,136 | 6/1989 | Brandt | 440/78 |
| 4,887,982 | 12/1989 | Newman et al. | 440/81 |
| 4,887,983 | 12/1989 | Bankstahl et al. | 440/57 |
| 4,897,058 | 1/1990 | McCormick | 440/80 |

(List continued on next page.)

*Primary Examiner*—Edwin L. Swinehart
*Attorney, Agent, or Firm*—Knobbe, Martens, Olson & Bear, LLP

[57] ABSTRACT

A transmission system for a counter-rotational propulsion device is easily incorporated into an existing outboard drive of a watercraft to convert the outboard drive from a single propeller drive to a counter-rotational dual propeller system. The transmission system involves a first transmission which selectively couples an inner propulsion shaft with an existing drive shaft of the outboard drive. The inner propulsion shaft in turn drives a rear propeller. A second transmission of the transmission system is provided between the inner propulsion shaft and an outer propulsion shaft. The second transmission reverses the rotational drive direction input by the inner propulsion shaft so as to drive the outer propulsion shaft in an opposite rotational direction. The outer propulsion shaft drives a front propeller which spins in an opposite direction to that of the rear propeller, but asserts a thrust in the same direction as the rear propeller.

43 Claims, 11 Drawing Sheets

U.S. PATENT DOCUMENTS

| | | | |
|---|---|---|---|
| 4,932,907 | 6/1990 | Newman et al. | 440/57 |
| 4,963,108 | 10/1990 | Koda et al. | 440/81 |
| 4,981,452 | 1/1991 | Grinde | 440/900 |
| 4,993,848 | 2/1991 | John et al. | 384/97 |
| 5,009,621 | 4/1991 | Bankstahl et al. | 440/75 |
| 5,017,168 | 5/1991 | Ackley | 440/82 |
| 5,030,149 | 7/1991 | Fujita | 440/75 |
| 5,074,814 | 12/1991 | Hogg | 440/79 |
| 5,087,230 | 2/1992 | Yates et al. | 440/80 |
| 5,186,609 | 2/1993 | Inoue et al. | 416/129 |
| 5,230,644 | 7/1993 | Meisenburg et al. | 440/80 |
| 5,232,386 | 8/1993 | Gifford | 440/81 |
| 5,249,995 | 10/1993 | Meisenburg et al. | 440/81 |
| 5,342,228 | 8/1994 | Magee et al. | 440/76 |
| 5,344,349 | 9/1994 | Meisenburg et al. | 440/80 |
| 5,352,141 | 10/1994 | Shields et al. | 440/80 |
| 5,366,398 | 11/1994 | Meisenburg et al. | 440/81 |

TRANSMISSION SYSTEM FOR COUNTER-ROTATIONAL PROPULSION DEVICE

BACKGROUND OF THE INVENTION

1. Field of the Invention

The present invention relates in general to a marine propulsion system, and in particular to a transmission system for a counter-rotational propulsion device.

2. Description of Related Art

Many outboard drives of marine watercrafts employ counter-rotational propeller systems which utilize a pair of counter-rotating propellers that operate in series about a common rotational axis. By using propeller blades having a pitch of opposite hands, the dual propeller arrangement provides significant improvement in propulsion efficiency. Such transmissions are common in both outboard motors and in outboard drive units of inboard/outboard motors.

Prior designs of counter-rotational propeller systems, however, are not easily or readily incorporated into existing single propeller outboard drives because of incompatibilities between the components of the old drive units and the counter-rotational propulsion systems. As such, the conversion process usually is not cost efficient. This new propulsion technology thus has generally not been integrated into existing outboard drives.

In addition, prior designs of counter-rotational propulsion systems tend to operate inefficiently when driven in reverse. In prior counter-rotational propulsion system designs, the propulsion system drives both propellers in opposite directions during a forward drive mode, and drives only a rear propeller during a reverse drive mode. The front propeller, however, tends to block the thrust stream produced by the rear propeller and thereby inhibits the performance of the outboard drive when operated in reverse.

SUMMARY OF THE INVENTION

A need therefore exists for a transmission system for a counter-rotational propulsion system which is-easily and readily incorporated into an existing outboard drive to convert the drive from a single propeller system to a counter-rotational propulsion system, and which improves the performance of the counter-rotational propulsion system when driven in reverse.

In accordance with an aspect of the present invention, a kit converts an existing outboard drive with a single propeller to an outboard drive having dual counter-rotational propellers. The existing outboard drive includes a drive shaft that is rotatably driven by a motor of the outboard drive. A first transmission selectively couples the drive shaft to a first propeller shaft to drive the first propulsion shaft in a first rotational direction. The kit includes a second propulsion shaft and a second transmission. The second transmission is coupled between the first propulsion shaft and the second propulsion shaft. The second transmission is configured to drive the second propulsion shaft in a second counter-rotational direction which is the reverse of the first rotational direction.

In accordance with another aspect of the present invention, an outboard drive for a watercraft comprises a drive shaft adapted to be rotationally driven by a motor of the outboard drive. A first transmission selectively couples the drive shaft to a first propulsion shaft. A second transmission is provided between the first propulsion shaft and a second propulsion shaft. The second transmission is configured to rotate the second propulsion shaft in a rotational direction opposite of the rotational direction that the first transmission rotatably drives the first propulsion shaft.

Another aspect of the present invention relates to a transmission system for selectively coupling a drive shaft with first and second propulsion shafts of a marine outboard drive. The transmission system comprises a first transmission which is driven by the drive shaft. The first transmission is connected to the first propulsion shaft and selectively couples the drive shaft to the first propulsion shaft so as to drive the first propulsion shaft in a first rotational direction. A second transmission is driven by the first propulsion shaft and is connected to the second propulsion shaft. The second transmission is configured to drive the second propulsion shaft in a second counter-rotational direction which is opposite to the first rotational direction.

In accordance with an additional aspect of the present invention, an outboard drive for a watercraft comprises first and second propulsion shafts which extend from a transmission system. The first propulsion shaft drives a front propulsion device and the second propulsion shaft drives a rear propulsion device. The transmission is configured to selectively couple the propulsion shafts with a drive shaft of the outboard drive to establish a forward drive condition in which both the front and rear propulsion devices are driven. The transmission also selectively couples the propulsion shafts with the drive shaft to establish a reverse drive condition in which both the front and rear propulsion devices are driven.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
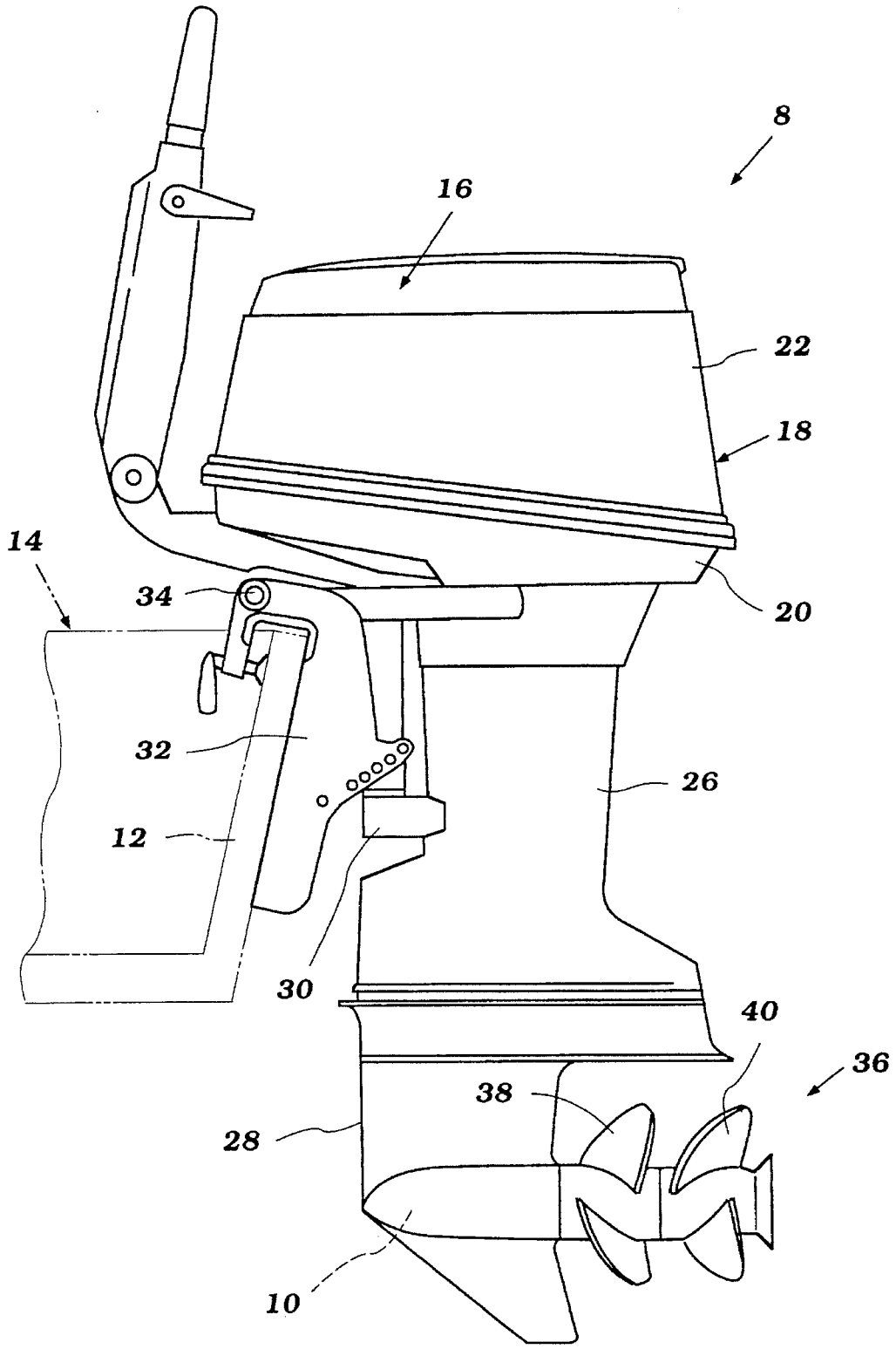
FIG. 1 is a side elevational view of a marine outboard motor configured in accordance with a preferred embodiment of the present invention.

FIG. 1 illustrates a marine outboard drive 8 which includes a transmission system 10 configured in accordance with a preferred embodiment of the present invention. In the illustrated embodiment, the outboard drive 8 is depicted as an outboard motor for mounting on a stern 12 of a watercraft 14. It is contemplated, however, that those skilled in the art will readily appreciate that the present transmission system 10 can be incorporated into stern drive units of inboard-outboard motors and into other types of watercraft drive units as well.

In the illustrated embodiment, the outboard drive 8 has a power head 16 which includes an engine. A conventional protective cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its output shaft (i.e., crankshaft) rotating about a generally vertical axis. The crankshaft (not shown) drives a drive shaft 24 (FIG. 2), as known in the art. The drive shaft 24 depends from the power head 15 of the outboard drive 8.

A drive shaft housing 26 extends downward from the lower tray 20 and terminates in a lower unit 28. As known in the art, the drive shaft 24 extends through and is journaled within the drive shaft housing 26.

A steering bracket 30 is attached to the drive shaft housing 26 in a known matter. The steering bracket 30 also is pivotably connected to a clamping bracket 32 by a pin 34. The clamping bracket 32, in turn, is configured to attach to the transom 12 of the watercraft 14. This conventional coupling permits the outboard drive 8 to be pivoted relative to the steering bracket 30 for steering purposes, as well as to be pivoted relative to the pin 34 to permit adjustment to the trim position of the outboard drive 8 and for tilt up of the outboard drive 8. Although not illustrated, it is understood that a conventional hydraulic tilt and trim cylinder assembly, as well as a conventional hydraulic steering cylinder assembly could be used as well with the present outboard drive 8.

The engine of outboard motor 8 desirably drives a counter-rotational propulsion device 36 as the present transmission 10 is particularly well suited for use with this type of propulsion device. In the illustrated embodiment, the propulsion device 36 includes a front propeller 38 designed to spin in one direction and to assert a forward thrust, and a rear propeller 40 designed to spin in the opposite direction and to assert a forward thrust.

Figure 2:
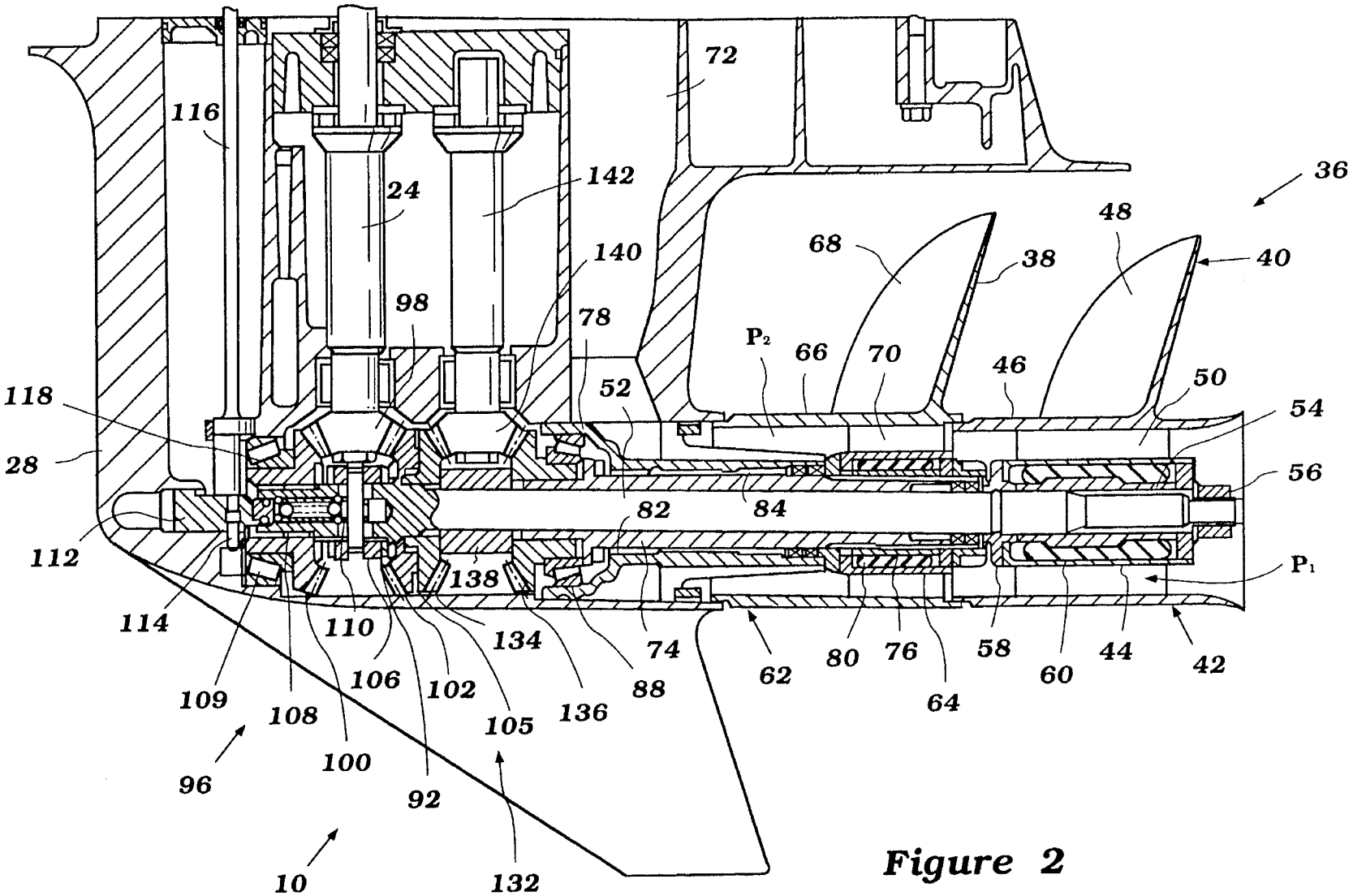
FIG. 2 is a sectional side elevational view of a lower unit of the marine outboard motor of FIG. 1.

FIG. 2 illustrates the components of the front and rear propellers 38, 40. The rear propeller 40 includes a boss 42 which is formed in part by an inner sleeve 44 and an outer sleeve 46 to which the propeller blades 48 are integrally formed. A plurality of radial ribs 50 extend between the inner sleeve 44 and the outer sleeve 46 to support the outer sleeve 46 about the inner sleeve 44 and to form a passage $P_1$ through the propeller boss 42. Engine exhaust is discharged through the passage $P_1$, as known in the art.

An inner propulsion shaft 52 drives the rear propeller boss 42. For this purpose, the rear end of the inner shaft 52 carries an engagement sleeve 54 having a spline connection with the rear end of the inner shaft 52. The sleeve 54 is fixed to the rear end of the inner shaft 52 between a nut 56 threaded on the rear end of the shaft 52 and an annular retainer ring 58 positioned between the front and rear propellers 38, 40. An elastic bushing 60 is interposed between the engagement sleeve 54 and the rear propeller boss 42 and is compressed therebetween. The bushing 60 is secured to the engagement sleeve 54 by a heat process known in the art. The frictional engagement between the boss 42 and the elastic bushing 60 is sufficient to transmit rotational forces from the sleeve 54, driven by the inner propulsion shaft 52, to the rear propeller blades 48.

The front propeller 38 likewise includes a front propeller boss 62. The front propeller boss 62 has an inner sleeve 64 and an outer sleeve 66. Propeller blades 68 of the front propeller 38 are integrally formed on the exterior of the outer sleeve 64. Ribs 70 interconnect the inner sleeve 66 and the outer sleeve 64 and form an axially extending passage $P_2$ between the sleeves 64, 66. The passage $P_2$ communicates with a conventional exhaust discharge passage 72 in the lower unit and with the exhaust passage of the rear propeller boss $P_1$.

An outer shaft 74 carries the front propeller 38. As best seen in FIG. 2, the rear end portion of the outer shaft 74 carries a front engagement sleeve 76 in driving engagement thereabout by a spline connection. The front engagement sleeve 76 is secured onto the outer shaft 74 between the annular retaining ring 58 and a rear end of a bearing carrier 78 of the lower unit 28.

A front annular elastic bushing 80 surrounds the front engagement sleeve 76. The bushing 80 is secured to the sleeve 76 by heat process known in the art.

The front propeller boss 62 surrounds the elastic bushing 80, which is held under pressure between the boss 62 and the sleeve 76 in frictional engagement. The frictional engagement between the propeller boss 62 and the bushing 80 is sufficient to transmit a rotational force from the sleeve 76 to the propeller blades 68 of the front propeller boss 62.

As seen in FIG. 2, the inner propulsion shaft 52 and the hollow outer propulsion shaft 74 extend from the transmission system 10 through the bearing carrier 78. The bearing carrier 78 rotatably supports the outer propulsion shaft 74, with the inner propulsion shaft 52 journaled within the outer propulsion shaft 74. A front needle bearing assembly 82 journals a front end of the outer propulsion shaft 74 within the bearing carrier, and a rear needle bearing assembly 84 supports the outer propulsion shaft 74 at the rear end of the bearing carrier 74.

Figure 3:
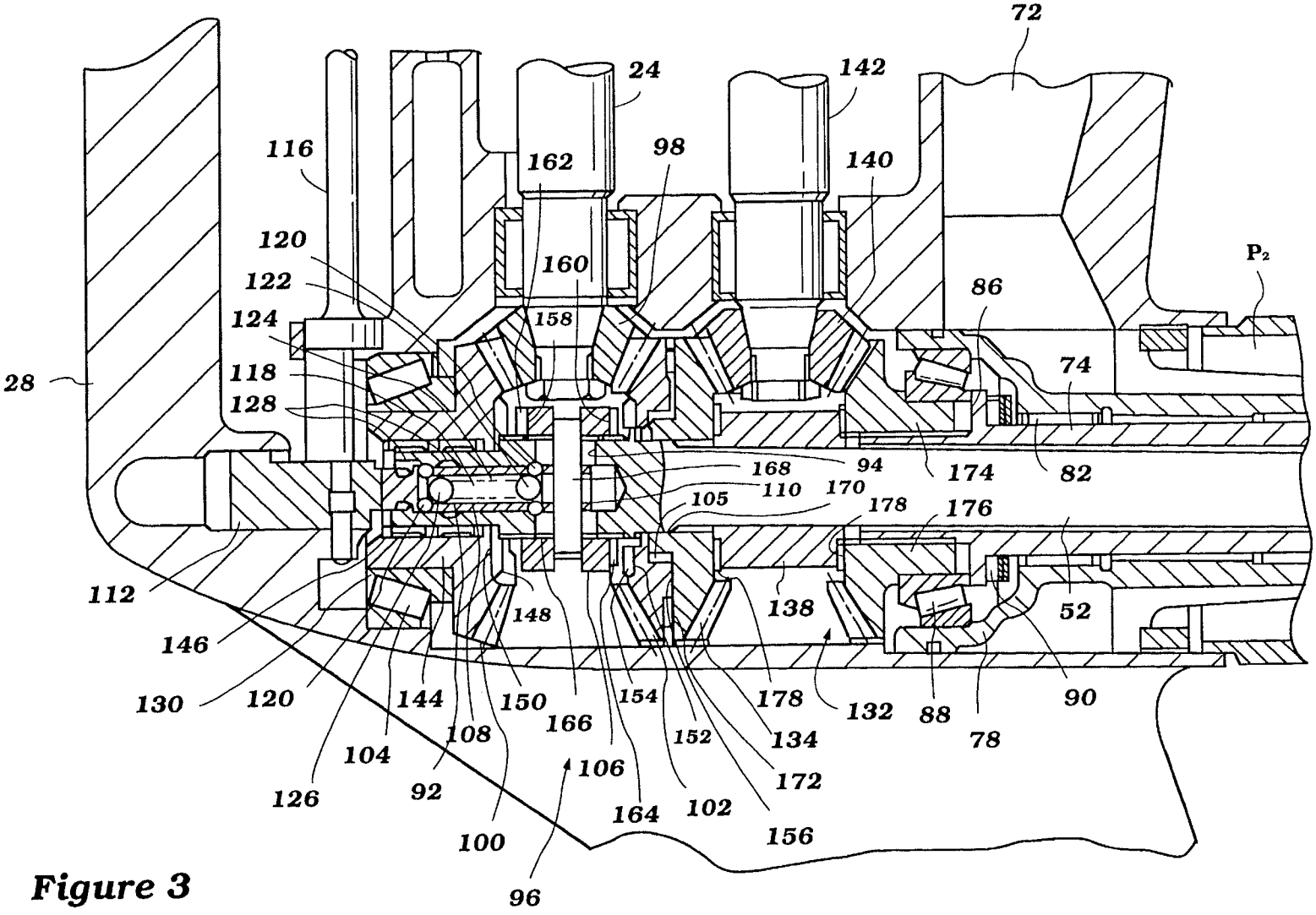
FIG. 3 is an enlarged sectional side elevational view of a transmission system of the lower unit of FIG. 2.

As best seen in FIG. 3, the outer propulsion shaft 74 also includes an integrally formed thrust flange 86 located forward of the front needle bearing assembly 82. The thrust flange 86 has a forward facing thrust surface that engages a thrust bearing assembly 88 so as to transfer the forward driving thrust from the propeller 38 through the thrust bearing 88 to the lower unit housing 28. Rearward driving thrusts are transmitted to the bearing carrier 78 and lower unit housing 28 from a rear facing thrust shoulder of the thrust flange 86. The rearward facing thrust shoulder of the thrust flange 86 engages a needle-type thrust bearing 90 having a race that is engaged with a shoulder of the bearing carrier 78. Because the thrust flange 86 and the bearing assemblies 88, 90 which journal the thrust flange 86 within the bearing carrier 78 form no significant part of the invention, further description of these elements is not believed necessary for an understanding of the present transmission 10.

As also illustrated in FIG. 3, the front end of the inner propulsion shaft 52 includes a longitudinal bore 92 which stems from the front end of the inner shaft 52 in an axially direction to a point beyond an axis of the drive shaft 24. Art aperture 94 extends through the inner shaft 52, transverse to the axis of the longitudinal bore 92, at a position that is generally beneath the drive shaft 24.

The individual components of the present transmission system 10 will now be described primarily with reference to FIGS. 2 and 3. Additionally, in connection with the description of the components, "front" and "rear" are used herein in reference to the bow of the watercraft 14.

As seen in FIG. 2, the drive shaft 24 extends from the drive shaft housing 26 into the lower unit 28 where a first transmission 96 of the present transmission system 10 selectively couples the drive shaft 24 to the inner propulsion shaft 52. The first transmission 96 advantageously is a forward/neutral/reverse-type transmission. The drive shaft 24 carries a drive gear 98 at its lower end, which is disposed within the lower unit 28 and which forms a portion of the first transmission 96. The drive gear 98 preferably is a bevel type gear.

The transmission also includes a pair of counter-rotating driven gears 100, 102 that are in mesh engagement with the drive gear 98. The pair of driven gears 100, 102 preferably are positioned on diametrically opposite sides of the drive gear 98 and are suitably journaled within the lower unit 28 by front and rear bearing assemblies 104, 105, respectively, as described in greater detail below.

FIG. 2 also illustrates a clutch 106 of the first transmission 96. In the illustrated embodiment, a plunger 108 operates the clutch 106. As discussed in detail below, the clutch 106 selectively couples the inner propulsion shaft 52 to either to the front gear 100 or to the rear gear 102. In the illustrated embodiment, the clutch 106 is positive clutch, such as, for example, a dog clutch; however, it is understood that the present transmission could be designed with a friction-type clutch.

The plunger 108 has a generally tubular shape and slides within the longitudinal bore 92 of the inner shaft 52 to actuate the clutch 92. The plunger 108 defines a front hole 110 that is positioned generally transverse to the longitudinal axis of the plunger 108. The hole 110 desirably is generally located symmetrically in relation to the aperture 94 (see FIG. 3) of the inner propulsion shaft 52.

As seen in FIG. 2, the forward end of the plunger 108 is captured within a slot formed in an actuating cam 112 which is slidably supported in a known manner in the front of the lower unit 28. The interconnection between the actuating cam 112 and the front end of the plunger 108 allows the plunger 108 to rotate with the inner shaft 52 relative to the actuating cam 112. The actuating cam 112 receives a crank portion 114 of an actuating rod 116 which is journaled for rotation in the lower unit 28 and extends upwardly to a transmission actuator mechanism (not shown). Rotation of the actuating rod 116 positively reciprocates the cam 112 and the plunger 108 so as to shift the clutch 106 between a forward drive position in which the clutch 106 engages the front gears 100, a position of non-engagement (i.e., the neutral position shown in FIG. 2), and a reverse drive position in which the clutch 106 engages the rear gear 102.

The first transmission also desirably includes the detent mechanism 118 which cooperates between the plunger 108 and the inner propulsion shaft 52 to retain the clutch 106 in the neutral position and to provide a predetermined force to resist shifting for torsionally loading the actuating rod 116. The torsional loading of the actuating rod 116 promotes snap engagement between the clutch 106 and the gears 100, 102 in the forward and reverse drive positions. This mechanism is of the type described in U.S. Pat. No. 4,570,776, issued Feb. 18, 1986, and entitled "Detent Mechanism for Clutches," which is assigned to the Assignee hereof. This patent provides full details of the detent mechanism, and also the clutch actuating mechanism as thus far described, and is hereby incorporated by reference.

As best seen in FIG. 3, the detent mechanism 118 includes a plurality of detent balls retained within the hollow bore of the plunger 108. A larger ball 122, urged by a compression spring 124, engages the detent balls 120. The opposite end of the spring engages another large ball 126 which operates with the detent balls 120 to urge then into engagement with cam grooves 128 formed in the inner surface of a longitudinal bore 92 in the front end of the inner propulsion shaft 52. The detent balls 120, as illustrated in FIG. 3, also are urged into a further neutral locking groove 130. In view of the description of the detent mechanism incorporated by reference, a further description of the detent mechanism is believed unnecessary.

With reference back to FIG. 2, the transmission system 10 also includes a second transmission 132 positioned between the inner and outer propulsion shafts 52, 74, and behind the first transmission 96. The second transmission 132 comprises a gear train formed in part by a front drive gear 134 connected to the inner propulsion shaft 52 and a rear driven gear 136 connected to outer propulsion shaft 74.

In the illustrated embodiment, these gears 134, 136 lie generally parallel to each other and rotate about the common axis of the inner and outer propulsion shafts 52, 74. A spacer 138, which is positioned between the gears 134, 136, maintains the gears 134, 136 in the desired spaced, parallel relationship. The thrust bearing 88 suitably journals the rear driven gear 136 within an enlarged forward portion of a bearing carrier 78, as described below.

The second transmission 132 is configured to rotatably drive the outer propulsion shaft 74 in an opposite rotational direction from that in which the first transmission 96 drives the inner propulsion 52. For this purpose, in the illustrated embodiment, the second transmission includes a pinion 140 carried at the lower end of a rotatably support shaft 142. The support shaft 142 is suitably journaled within the lower unit 28 and lies generally parallel to the drive shaft 24. The support shaft 142 holds the pinion 140 in mesh engagement with the drive and driven gears 134, 136 such that the driven gear 136 rotates in a direction opposite of that in which the drive gear 134 rotates.

FIG. 3 best illustrates the gear and bearing arrangements of the first and second transmissions 96, 132 and the arrangement of the transmissions with one another, as well as with the inner and outer propulsion shafts 52, 74. The following thus provides a further description of the components of the first and second transmissions 96,132 with reference to FIG. 3.

Each driven gear 100, 102 of the first transmission 96 is positioned at about a 90° shaft angle with the drive gear 98.

That is, the propulsion shafts 52, 74 and the drive shaft 24 desirably intersect at about a 90° shaft angle; however, it is contemplated that the drive shaft 24 and the propulsion shafts 52, 74 can intersect at almost any angle.

In the illustrated embodiment, the pair of driven gears are a front bevel gear 100 and an opposing rear bevel gear 102. The front gear 100 includes a bearing hub 144 which is journaled within the lower unit by the front thrust bearing 104. The front thrust bearing 104 rotatably supports the front gear 100 in mesh engagement with the drive gear 98.

The hub 144 has a central bore through which the inner propulsion shaft 52 passes when assembled. A plurality of needle bearings 146 journal the inner propulsion shaft 52 within the central bore of the front gear hub 144. As seen in FIG. 3, the gear hub 144 includes a counterbore to receive the needle bearings 146 in this location.

The front gear 100 also includes a series of teeth 148 formed on an annular rear facing engagement surface 150. The teeth 148 positively engage the clutch 106 of the first transmission 96, as discussed below.

As seen in FIG. 3, the rear gear 102 also includes an annular front engagement surface 152 which carries a series of clutching teeth 154. The teeth 154 are configured to positively engage the clutch 106 of the first transmission 96, as discussed below.

The rear gear 102 includes an inner .bore and a counterbore. The inner bore extends through the gear from the front engagement surface 152 to a rear end 156. The inner bore has a sufficiently sized diameter to receive the inner propulsion shaft 52 when assembled. The counterbore extends into the gear 102 from its rear end 156. The counterbore has a sufficiently sized diameter to receive a portion of the drive gear 134 of the second transmission 132 to support the rear gear 102 of the first transmission 96 about the inner propulsion shaft 52, as described below.

The clutch 106 of the first transmission 96 generally has a spool-like shape and includes an axial bore which extends between an annular front end plate 158 and an annular rear end plate 160. The bore is sized to receive the inner propulsion shaft 52. The annular end plates 158,160 of the clutch 106 are substantially coextensive in size with the annular engagement surfaces 150, 152 of the front and rear gears 100, 102, respectively. The annular end plates 158, 160 each support a plurality of clutching teeth 162, 164 which correspond in size and number with the teeth 148, 154 formed on the respective engagement surfaces 150, 152 of the front and rear gears 100, 102.

The front clutch 106 has a spline connection (generally referenced as reference numeral 166) to the inner propulsion shaft 52. Internal splines of the front clutch 106 matingly engage external splines on the external surface of the inner drive shaft 52. This spline connection 166 provides a driving connection between the front clutch 106 and the inner propulsion shaft 52, while permitting the front clutch 106 to slide over the inner propulsion shaft 52, as discussed below.

The clutch 106 also includes a hole that extends through the midsection of the clutch 106 in a direction generally transverse to the longitudinal axis of the clutch. The hole is sized to receive a pin 168 which, when passed through the front aperture 94 of the inner propulsion shaft 52 and through front hole 110 of the plunger 108, interconnects the plunger 108 and the front clutch 106 with a portion of the inner shaft 52 interposed therebetween. The pin 168 may be held in place by a press-fit connection between the pin 162 and the front hole 110 of the plunger 108, or by a conventional coil spring (not shown) which is contained within a groove about the middle of the front clutch 106.

With reference to the second transmission 136 illustrated by FIG. 3, the front drive gear 134 desirably is a bevel type gear which includes a bearing hub 170. The bearing hub 170 defines a central bore through which the inner propulsion shaft 52 passes when assembled. The inner propulsion shaft 52 includes a small annular flange 172 which prevents the front drive gear 134 from sliding forward over the shaft 52. A spline connection connects the front drive gear 134 on the inner propulsion shaft 52 such that the front drive gear 134 of the second transmission 132 rotates with the inner propulsion shaft 52.

As noted above, the front drive gear 134 of the second transmission 132 supports the rear driven gear 102 of the first transmission 96 about the inner propulsion shaft 52. The rear gear 102 is slipped over the hub 170 of the front drive gear 134 with the counterbore receiving the hub 170. The bearing assembly 105 is interposed between the hub 170 and the rear gear 102 in the counterbore to journal the rear gear 102 about the hub 170 of the front drive gear 134. A needle bearing assembly 170 also is interposed between the juxtaposed surfaces of the gears 102, 134 to allow the gears 102, 134 to rotate relative to each other with minimal friction.

The drive gear 134 of the second transmission 132 drives the rear driven gear 136 through the pinion 140. In the illustrated embodiment, both the pinion and rear driven gear 136, like the front drive gear 134 of the second transmission 132, are bevel gears. The gear ratio between the front drive gear 134 and the pinion 140 desirably is about equal to the gear ratio between the rear driven gear 136 and the pinion 140 such that the front drive gear 134 and the rear driven gear 136 rotate at about the same rotational speed, but in opposite directions.

The rear gear 136 includes a bearing hub 174 which is journaled within the enlarged end of the bearing carrier 78 by the rear thrust bearing assembly 88. The bearing hub 78 defines a central bore which receives both the inner and outer propulsion shafts 52, 74 when assembled. The outer propulsion shaft 74, however, does not project forward of the rear driven gear 136.

A spline connection 176 between the rear gear 136 and the outer propulsion shaft 74 connects these elements together in order for the rear gear 136 to rotatably drive the outer shaft 74. Internal splines formed on the wall of the bearing hub inner bore mate with external splines formed on the exterior of the outer propulsion shaft 74 at the front end of the shaft.

As noted above, the spacer sleeve 138 holds the front and rear gears 134, 136 apart. The spacer sleeve 138 has a sufficiently sized inner diameter to slide over the inner propulsion shaft 52. Anti-friction members 178 are positioned between the spacer sleeve 138 and the front and rear gears 134, 136 to allow the gears 134, 136 to rotate relative to the spacer sleeve 138 with minimal friction.

The operation of the present transmission system 10 will now be described with primary reference to FIG. 3. FIG. 3 illustrates the clutch 106 of the first transmission 96 in a neutral position, i.e., in a position of non-engagement with the gears 100, 102. The detent mechanism 118 retains the plunger 108 and the coupled clutch 106 in this neutral position.

To establish a forward drive condition, the actuator cam 112 moves the plunger 108, which in turn, slides the clutch 106 over the inner propulsion shaft 52 to engage one of the driven gears 100, 102. In the illustrated embodiment, forward motion of the plunger 108 establishes the forward drive condition by forcing the clutch 106 into engagement with the front gear 100 with the corresponding clutching teeth 148,162 mating. So engaged, the front gear 100 drives the inner propulsion shaft 52 through the spline connection 66 between the clutch 106 and inner propulsion shaft 52. The inner propulsion shaft 52 thus drives the rear propeller 40 in a first direction which asserts a forward thrust.

The inner propulsion shaft 52 also drives the second transmission 132. The front drive gear 136 of the second transmission 132 rotates in the first rotational direction with the inner propulsion shaft 52. The front drive gear 134 in turn drives the rear driven gear 136 in a reverse rotational direction via the pinion 140.

The rear gear 136 of the second transmission 132 drives the outer propulsion shaft 74 through the spline connection 176 between these components. The outer propulsion shaft 74 rotates at the same rotational speed that the inner shaft 52 rotates because of the symmetric gear sizes in the second transmission 132 discussed above. The outer propulsion shaft 74 thus drives the front propeller 38 to spin in an opposite direction to that of the rear propeller 40 and to assert a forward thrust.

To establish the reverse drive condition, the actuator cam 112 moves the plunger 108 and clutch 106 in the opposite direction (e.g., in the rearward direction) to contact the other driven gear. In the illustrated embodiment, rearward movement of the plunger 108 positively forces the clutch 106 to engage the rear gear 102 of the front transmission 96 with the corresponding clutching teeth 154,164 mating. So engaged, the rear gear 102 drives the inner propulsion shaft 52 through the spline connection 166 between the clutch 106 and the shaft 52. The inner propulsion shaft 52, in turn, drives the rear propeller 40 in a direction which asserts a reverse thrust to propel the watercraft in reverse.

The inner propulsion shaft 52 also drives the outer propulsion shaft 74 via the second transmission 132. The second transmission 132 reverses the directional spin input by the inner shaft 52 so as to drive the outer shaft 74 in an opposite rotational direction. The outer shaft 74 thus drives the front propeller 38 in an opposite direction to that of the rear propeller 40 under the reverse drive condition, such that the front propeller 38 also asserts a reverse thrust.

FIGS. 4–12 illustrate additional preferred embodiments of the present transmission with variations relating to several of the bearing assemblies and to the structure of the second transmission. The embodiments illustrated by these figures, however, are otherwise identical to the transmission of described above. Accordingly, the foregoing description of the transmission should be understood as applying equally to the embodiments of FIGS. 4–12, unless specified to the contrary.

Figure 4:
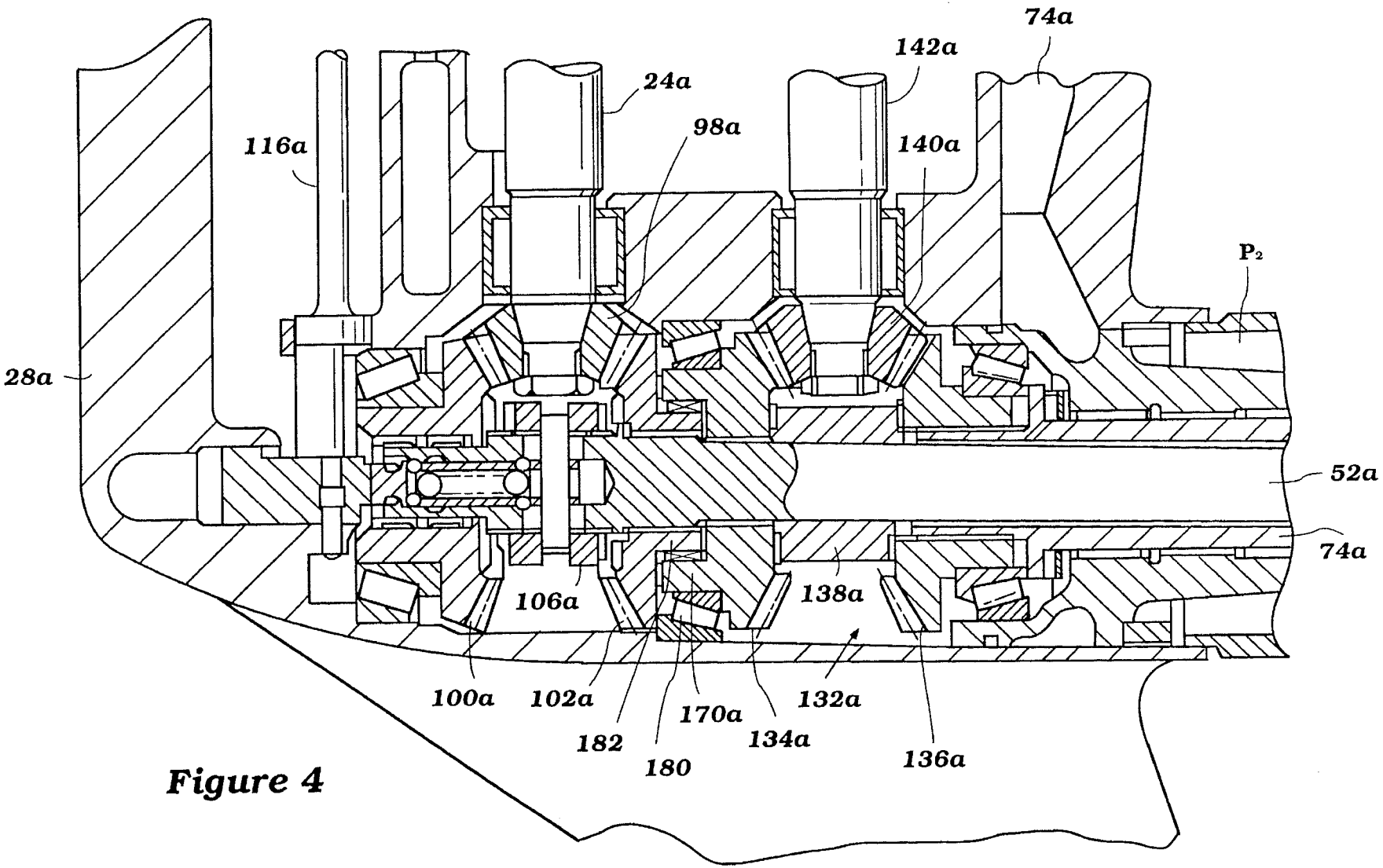
FIG. 4 is a sectional side elevational view of a transmission system of a lower unit of a marine outboard drive configured in accordance with another preferred embodiment of the present invention.

FIG. 4 illustrates an additional embodiment of the present transmission system with another bearing arrangement to support the rear gear 102*a* of the first transmission 96*a* and the front drive gear 134*a* of the second transmission 132*a* in the lower unit 28*a*. Where appropriate, like numbers with an "a" suffix have been used to indicate like parts of the two embodiments for ease of understanding.

As seen in FIG. 4, a thrust bearing 180 supports the bearing hub 170*a* of the front drive gear 134*a* of the second transmission 132*a* within the lower unit 28*a*. The bearing hub 170*a* also defines a counterbore which extends into the front gear 134*a* from its front side.

The rear driven gear 102*a* of the first transmission 96*a* includes a bearing hub 182, rather than the counterbore as in the previous embodiment. The bearing hub 182 defines the inner bore through which the inner propulsion 52*a* passes when assembled. The bearing hub 182 also has a sufficiently small outer diameter so as to be received within the counterbore of the front drive gear 134*a* of the second transmission 132*a* when assembled.

As seen in FIG. 4, the hub 170*a* of the front gear 134*a* of the second transmission 132*a* receives the hub 182 of the rear gear 102*a* of the first transmission 96*a* to support the rear gear 102*a* about the inner propulsion shaft 52*a* and in mesh engagement with the drive gear 98*a* of the first transmission 96*a*. The bearing assembly 102*a* journals the bearing hub 182 of the rear gear 102*a* with the counterbore of the front gear hub 170*a*.

Figure 5:
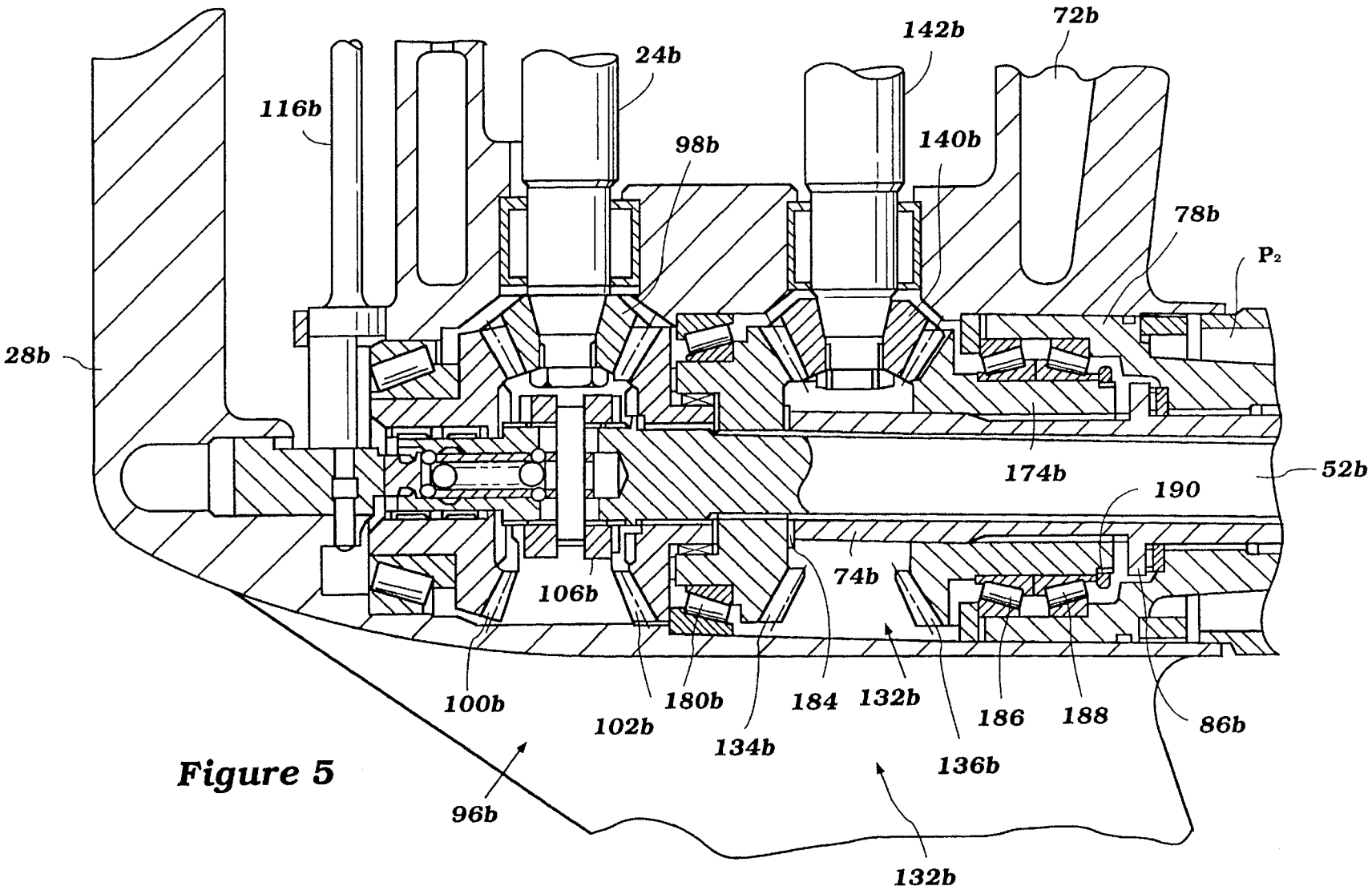
FIG. 5 is a sectional side elevational view of a transmission system of a lower unit of a marine outboard drive configured in accordance with an additional preferred embodiment of the present invention.

FIG. 5 illustrates an additional preferred embodiment of the present transmission system which is substantially identical to the transmission system illustrated in FIG. 4, with the exception of the front end of the outer propulsion shaft and the bearing assembly which journals the rear gear of the second transmission within the bearing carrier of the lower unit. Where appropriate, like reference numerals with a "b" suffix have been used to indicate like components between these embodiments.

In the illustrated embodiment of FIG. 5, the outer propulsion shaft 74*b* extends forward, entirely through the second gear 136*b* of the second transmission 132*b*. The front end of the outer propulsion shaft 74*b* lies adjacent to the first gear 134*b* of the second transmission 132*b*. Needle-type thrust bearings 184 journal the front end of the propulsion shaft 74*b* against the first drive gear 134*b* which rotates in an opposite direction to the outer propulsion shaft 74*b*. The thrust bearings 184 take a forward driving thrust from the outer propulsion shaft 74*b* so as to transfer the forward driving thrust from the propeller 38*b* to the lower unit housing 28*b* through the roller thrust bearing 180*b* which supports the first driven gear 134*b* of the second transmission 132*b*. Rearward driving thrusts are transmitted to the bearing carrier 78*b* and lower unit housing 28*b* from a rear facing thrust shoulder of the thrust flange 86*b* of the outer propulsion shaft 74*b*, as described above.

The rear gear 136*b* of the second transmission 132*b* includes an elongated bearing hub 174*b* which is journalled by a pair of taper roller bearings 186, 188. The roller bearings 186, 188 lie back-to-back with the front roller bearing 186 of the pair abutting a forward shoulder of the bearing hub 174*b*. A retainer ring 190 secures the rear roller bearing 188 on the bearing hub 174*b* and contacts the rear roller bearing 188 so as to transfer forward thrust loadings to the roller bearings 186, 188. The roller bearings 186, 188 together take the thrust loadings on the rear gear 136*b* of the second transmission 132*b*.

Figure 6:
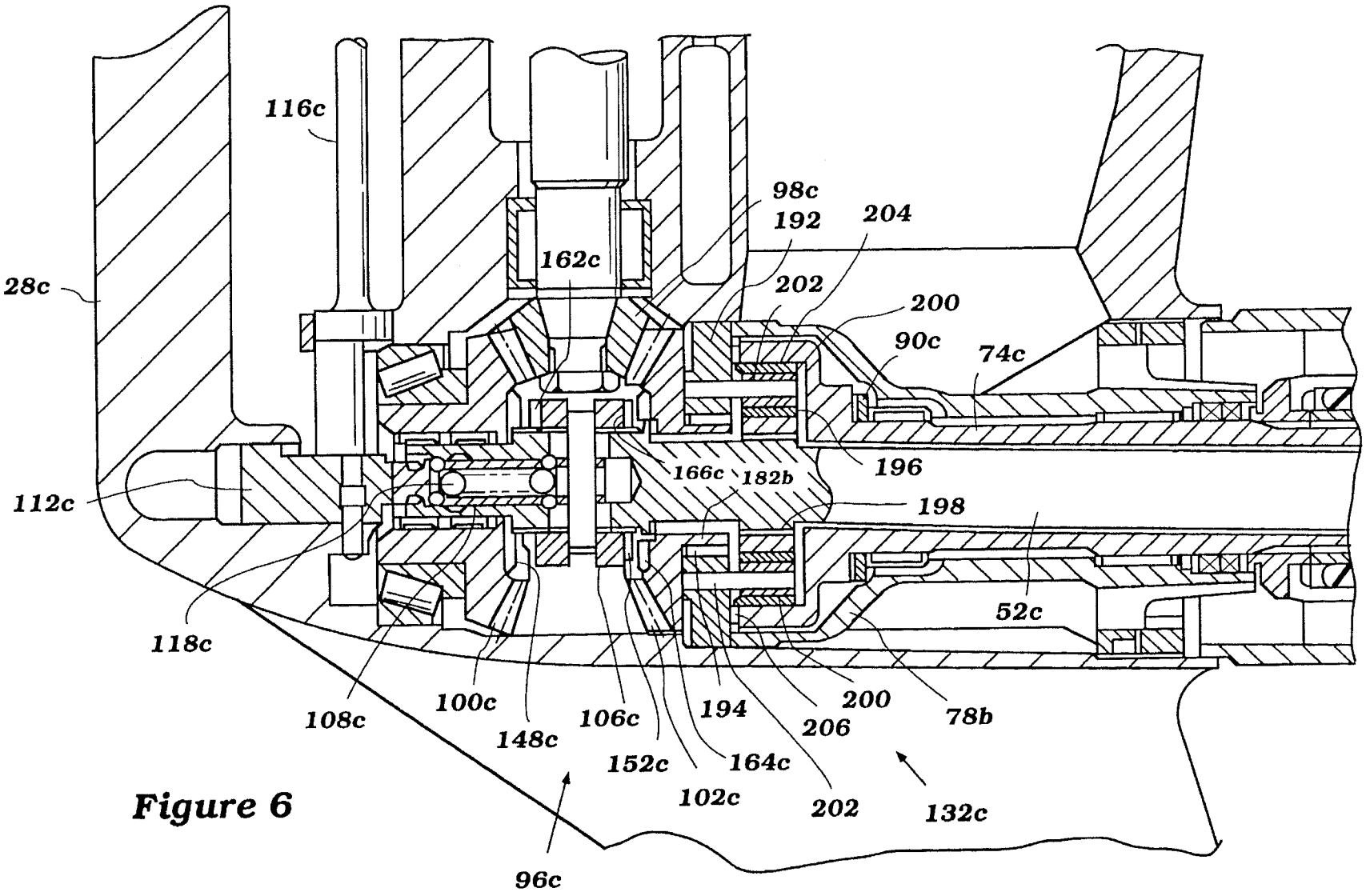
FIG. 6 is a sectional side elevational view of a transmission system of a lower unit of a marine outboard drive configured in accordance with a further preferred embodiment of the present invention.

FIG. 6 illustrates an alternative embodiment of the present transmission system with another configuration of the second transmission. Where appropriate, like numbers with a "c" suffix have been used to indicate like parts of the embodiments for ease of understanding.

As seen in FIG. 6, the rear gear 102*c* of the first transmission 96*c* includes a bearing hub 182*c*. The bearing hub 182*c* defines an inner bore through which the inner propulsion shaft 52*c* passes when assembled.

A closure plate 192, which is fixed to the enlarged front end of the bearing carrier 78*c*, supports the bearing hub 182*c* of the rear gear 102*c*. The closure plate 192 includes a central hole having a diameter sized to receive the rear gear bearing hub 182*c*. A needle bearing assembly 194 supports and journals the bearing hub 182*c* within the central hole of the closure plate 192. In this manner, the closure plate 192 supports the rear gear 102*c* in mesh engagement with the drive gear 98*c* of the first transmission 96*c*.

In the illustrated embodiment, the second transmission 132*c* comprises a planetary gear train. The inner propulsion shaft 52*a* carries a sun gear 196 and drives it through a spline connection 198. The sun gear 196 thus rotates with the inner propulsion shaft 52*c*.

The sun gear 196 drives a plurality of planet gears 200. As seen in FIG. 6, a plurality of support pins 202 support the planet gears 200 about the sun gear 196 and in mesh engagement with the sun gear 196. Each planet gear 200 rotates about the fixed support pin 202. The support pins 202 and the associated planet gears 200 desirably are positioned about the sun gear 196 at equally spaced locations around the circumference of the sun gear 196.

The planet gears 200 in turn drive a ring gear 204 coupled to the outer propulsion shaft 74*c*. In the illustrated embodiment, the outer propulsion shaft 74*c* includes an enlarged front end which defines a large counterbore in which the second transmission 132*c* is positioned. The ring gear 204 is attached to or is integrally formed with the inner surface of the counterbore. In this manner, the outer propulsion shaft 74*c* moves with the ring gear 204.

As seen in FIG. 6, the front end of the outer propulsion shaft 74*c* engages a front thrust bearing assembly 206 so as to transfer the forward driving thrust from the propeller 38*c* through the thrust bearing 206 and the closure plate 192 to the lower unit 28*c*. Rearward driving thrusts are transmitted to the bearing carrier 78*c* and the lower unit 28*c* from a rear facing thrust shoulder formed behind the enlarged forward end of the outer propulsion shaft 74*c*. The rearward facing thrust shoulder engages a needle-type thrust bearing 90*c* having a race that is engaged with a shoulder of the bearing carrier 78*c*.

The following elaborates on the previous description of the operation of the present transmission system. FIG. 6 illustrates the clutch 106*c* of the first transmission 96*c* in the neutral position. The detent mechanism 118*c* retains the plunger 108*c* and the coupled clutch 106*c* in this neutral position.

To establish a forward drive condition, the actuator cam 112*c* moves the plunger 108*c* to slide the clutch 106*c* forward to engage the front gear 100*c* of the first transmission 96*c*. The front gear 100*c* drives the inner propulsion shaft 52*c* through the spline connection 166*c* between the clutch 106*c* and the inner propulsion shaft 52*c*. The inner propulsion shaft 52*c* drives the rear propeller 40*c* in a first rotational direction to assert a forward thrust.

The inner propulsion shaft 52*c* also drives the sun gear 196 of the second transmission 132*c* which rotates with the inner propulsion shaft 52*c*. The sun gear 196 in turn drives the planet gears 200 which rotate about the respective support shafts 202 in a rotational direction opposite that of the sun gear 196. The planet gears 200 drive the ring gear 204 in the same rotational direction of the planet gears 200, opposite to the rotational direction of the sun gear 196. The outer propulsion shaft 74*c* thus rotates in a direction opposite to that of the inner propulsion shaft 52*c*. The outer propulsion shaft 74*c* thus drives the front propeller 38*c* (FIG. 1) to spin in a counter-rotational direction from the first propeller 40*c* and to assert a forward thrust.

With reference to FIG. 6, to establish the reverse drive condition, the actuator cam 112*c* moves the plunger 108*c* and clutch 106*c* rearward to positively engage the rear gear 102*c* of the first transmission 96*c*. So engaged, the rear gear 102*c* drives the inner propulsion shaft 52*c* to spin the rear propeller 40*c* in a direction with asserts a reverse thrust to propel the watercraft in reverse.

The inner propulsion shaft 52*c* also drives the outer propulsion shaft 74*c* via the second transmission 132*c*. The second transmission 132*c* reverses the directional spin input by the inner shaft 52*c* so as to drive the outer shaft 74*c* in an opposite rotational direction. The outer shaft 74*c* thus drives the front propeller 38*c* in an opposite direction to that of the rear propeller 40*c* under the reverse drive condition. The front propeller 38*c* asserts a reverse thrust when driven in this manner.

It should be noted that a rotational speed differential exists between the inner shaft 52*c* and the outer shaft 74*c* because of a reduction of rotational speed through the planetary gear train of the second transmission 132*c*. The front and rear propellers 38*c*, 40*c*, however, are designed with differing pitches to compensate for the unbalanced driving forces between the inner and outer shafts 52*c*, 74*c* due to the rotational speed differential between these shafts 52*c*, 74*c*. In the illustrated embodiment, the pitch on the blades 68*c* the front propeller 38*c* is larger than the pitch on the blades 48 of the rear propeller for this purpose.

Figure 7:
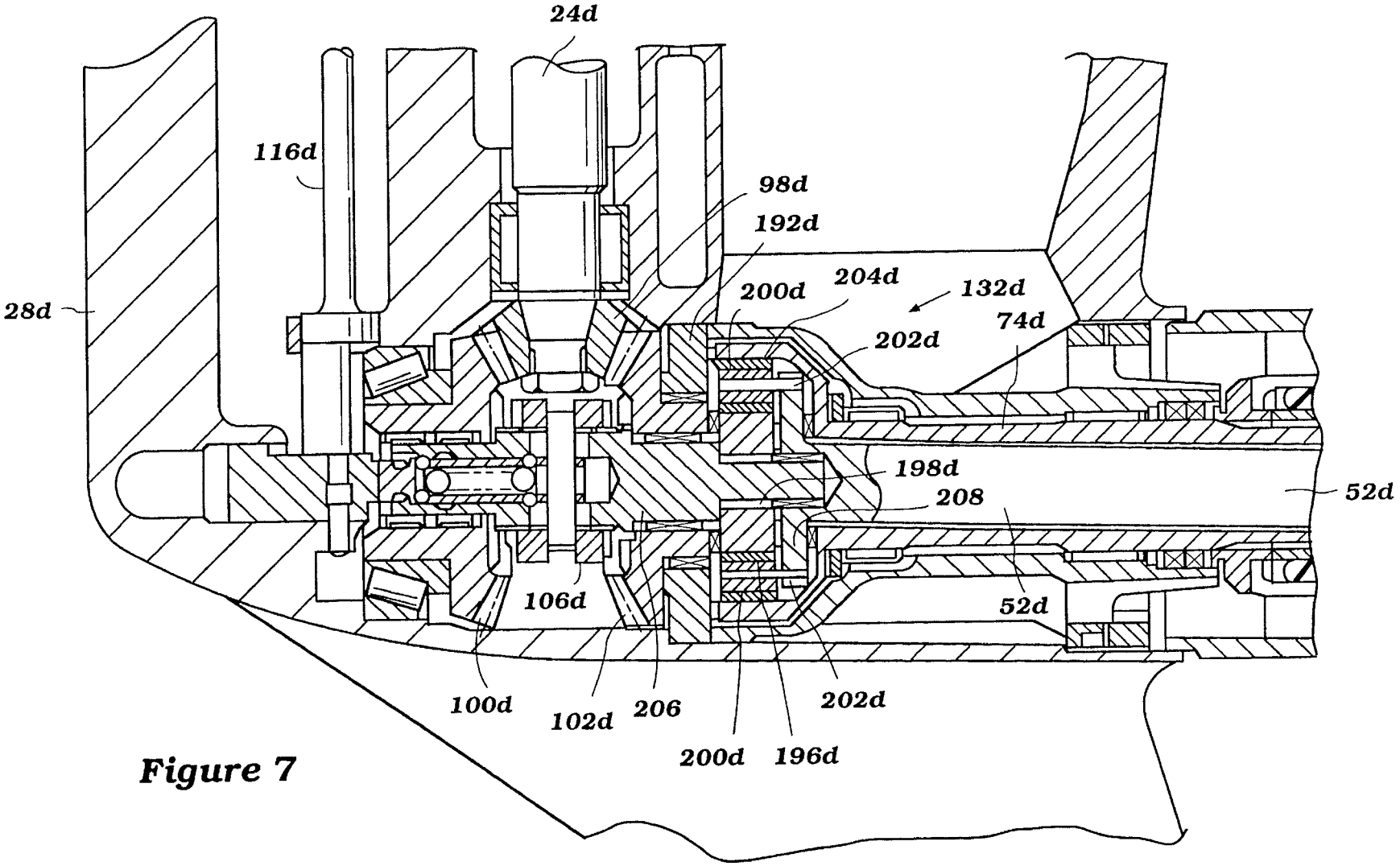
FIG. 7 is a sectional side elevational view of a transmission system of a lower unit of a marine outboard drive configured in accordance with yet another preferred embodiment of the present invention.

FIG. 7 illustrates yet another preferred embodiment of the present transmission system with another configuration of the second transmission. Where appropriate, like reference numerals with a "d" suffix have been used to indicate like components of the embodiments for ease of understanding.

As seen in FIG. 7, the clutch 106*d* drives an input shaft 206 of the second transmission 132*d*, rather than the inner propulsion shaft 52*d* as in the previous embodiments. The input shaft 206 extends through the rear gear 102*d* of the first transmission 96*d*. On the rear side of the closure plate 192*d*, the input shaft carries and drives a sun gear 196*d* through a spline connection 198*d*. The rear end of the input shaft 206 is piloted into the front end of the inner propulsion shaft 52*d* and is suitably journaled therein.

The inner propulsion shaft 52*d* includes an annular flange 208 at its front end. The annular flange 208 supports a plurality of support pins 202*d* which extend in the forward direction from the flange 208, generally parallel to the axis of the inner propulsion shaft 52*d*.

The sun gear 196*d* carried by the input shaft 206 drives a plurality of planet gears 200*d*. As seen in FIG. 7, the support pins 202*d* carried by the flange 208 of the inner propulsion shaft 52*d* support the planet gears 200*d* about the sun gear 196*d* and in mesh engagement with the sun gear 196*d*. Each planet gear 200*d* rotates about the respective support pin 202*d*. The support pins 202*d* and the associated planet gears 200*d* desirably are positioned about the sun gear 196*d* at equally spaced locations around the circumference of the sun gear 196*d*.

The planet gears 200*d* in turn drive a ring gear 204*d* which is coupled to the outer propulsion shaft 74*d*. In the illustrated embodiment, the outer propulsion shaft 74*d* includes an enlarged front end which defines a large counterbore in which the second transmission 132*d* is positioned. The ring gear 204*d* is integrally formed on the inner surface of the counterbore. In this manner, the outer propulsion shaft 74*d* rotates with the ring gear 204*d*.

The following elaborates upon the previous description of the operation of the present transmission system 10*d*. It should be understood that the operation of the first transmission 96*d* of the present transmission system 10*d* is substantially identical to that described in connection with the embodiment illustrated in FIG. 6, and, thus, the following discussion of the operation of the present transmission system 10*d* will focus on the operation of the second transmission 132*d*.

In the illustrated embodiment, in which a forward drive condition is established by moving the plunger 108*d* forward, the front gear 100*d* drives the input shaft 206 through the coupled clutch 106*d*. The input shaft 206 drives the sun gear 196*d* of the second transmission 132*d*, which rotates in the same direction as the front driven gear 100*d*. The sun gear 196*d* in turn drives the planet gears 200*d* which individually rotate about the respective support shafts 202*d* in a rotational direction opposite that of the sun gear 196*d*. The rotation of the planet gears 200*d* also produces an overall motion of the planet gears 200*d* about the sun gear 196*d* such that the entire planetary gear assembly orbits the sun gear 196*d*. The orbital motion of the planet gears 200*d* about the sun gear 196*d* causes the annular flange 208 of the inner shaft 52*d* to rotate in the same direction as the input shaft 206. Thus, the inner propulsion shaft 52*d* rotates in the same direction as the input shaft 206*d* and drives the rear propeller 40 in this rotational direction to assert a forward thrust.

The planet gears 200*d* also drive the ring gear 204*d* in the same rotational direction as the planet gears 200*d* rotate about the support pins 202*d*, and in a rotational direction opposite to that of the sun gear 196*d*. The outer propulsion shaft 74*d* thus rotates in a direction opposite to that of the inner propulsion shaft 52*d*. The outer propulsion shaft 74*d* thus drives the front propeller 38*d* (FIG. 1) to spin in a counter-rotational direction from the first propeller 40*d* and to assert a forward thrust.

The operation of the second transmission 132*d* under the reverse drive condition is substantially identical to that described above in connection with the operation under the forward drive condition. In the reverse drive condition, the input shaft 206 drives the inner propulsion shaft 52*d* through the interaction between the sun gear 198*d* and the planet gears 200*d*. The input shaft 206 thus drives the inner propulsion shaft 52*d* in the same direction that the rear driven gear 102*d* of the first transmission 96*d* rotates. The planet gears 200*d* in turn rotate the ring gear 204*d* in an opposite rotational direction. Accordingly, the inner propulsion shaft 52*d* and the outer propulsion shaft 74*d* rotate in opposite directions which in turn causes the front and rear propellers 38*d*, 40*d* to spin in opposite rotational directions, yet to assert a combined rearward thrust to drive the watercraft 14*d* in reverse.

As noted above in connection with the embodiment of FIG. 6, the planetary gear train of the second transmission 132*d* creates a rotational speed differential between the inner propulsion shaft 52*d* and the outer propulsion shaft 74*d*. In order to compensate for this speed differential, the pitch on the front and rear propellers 38*d*, 40*d* differ so that the output torque of each propeller becomes substantially equal.

Figure 8:
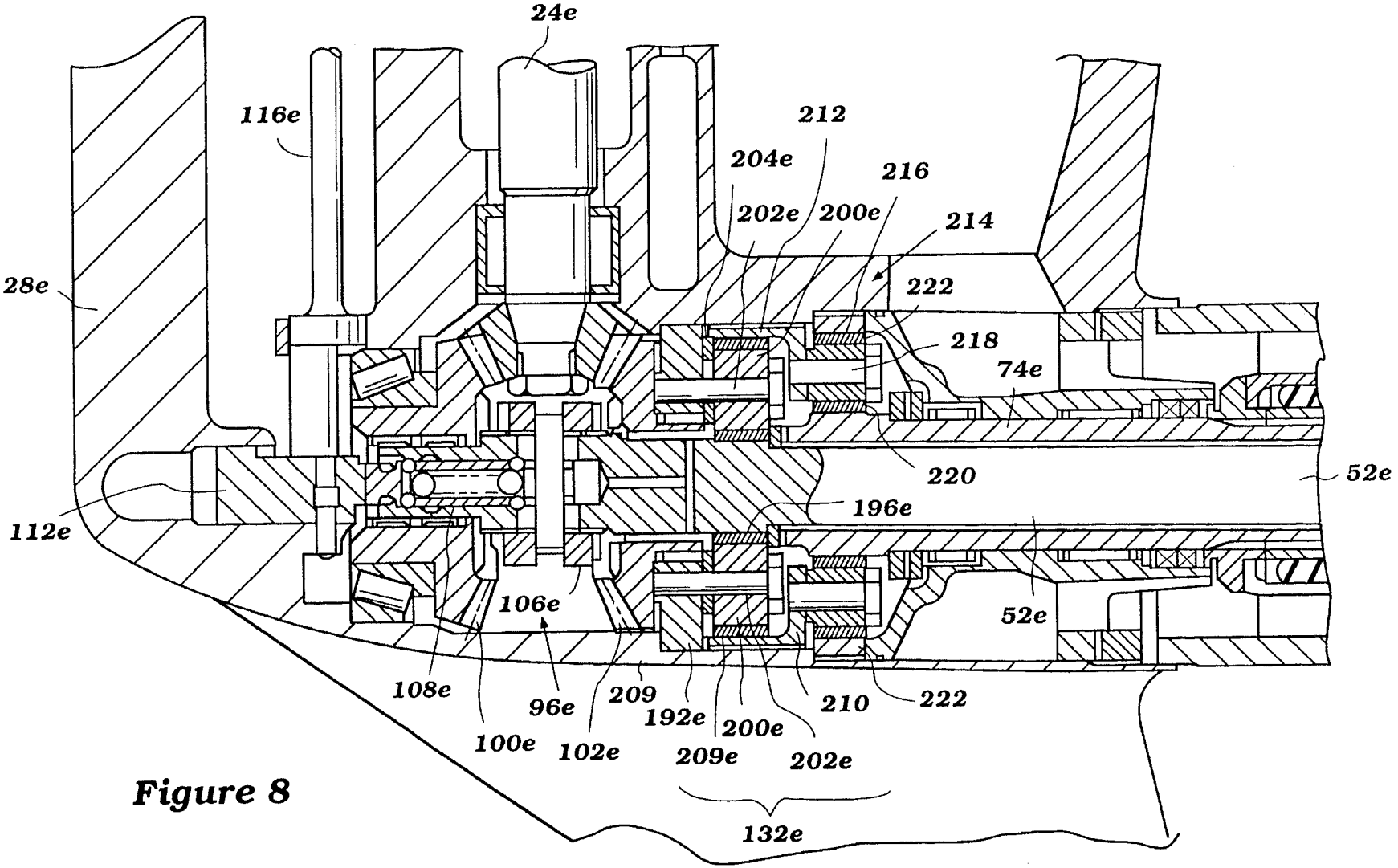
FIG. 8 is a sectional side elevational view of a transmission system of a lower unit of a marine outboard drive configured in accordance with an additional preferred embodiment of the present invention.

FIG. 8 illustrates a further preferred embodiment of the present transmission system with another configuration of the second transmission. Where appropriate, like numbers with an "e" suffix have been used to indicate like parts of the embodiments for ease of understanding.

The first transmission 96*e* of the present transmission system 10*c* is identical to that described above in connection with FIG. 6. It therefore is understood that the above description of the first transmission applies equally to the first transmission 96*e* of the present embodiment.

As illustrated in FIG. 8, the second transmission 132*e* comprises a pair of planetary gear trains which are arranged in series. The first planetary gear train 209 includes a sun gear 196*e* carried and driven by the inner propulsion shaft 52*e*. The sun gear 196*e* thus rotates with the inner propulsion shaft 52*e*.

The sun gear 196*e* drives a plurality of planet gears 200*e*. As seen in FIG. 8, a plurality of support pins 202*e* support the planet gears 200*e* about and in mesh engagement with the sun gear 196*e*. Each planet gear 200*e* rotates about the fixed support pin 202*e*. The support pins 202*e* and the associated planet gears 200*e* desirably are positioned about the sun gear 196*e* at equally spaced positions around the circumference of the sun gear 196*e*.

The planet gears 200*e* in turn drive a ring gear 204*e* coupled to a carrier 210. In the illustrated embodiment, the carrier 210 includes an enlarged front end 212 inside which the ring gear 204*e* is integrally formed. In this manner, the carrier 210 moves with the ring gear 204*e*.

The second planetary gear train 214 includes a plurality of planet gears 216 carried by the carrier 210. As seen in FIG. 8, a plurality of support pins 218 which extend from the carrier 210, support the planet gears 216 about and in mesh engagement with a sun gear 220 of the second planetary gear train 214. Each planet gear 216 rotates about the respective support pin 218. The support pins 218 and the associated planet gears 216 desirably are positioned about the sun gear 220 at equally spaced positions around the circumference of the sun gear 220.

The second sun gear 220 is fixed to the front end of the outer propulsion shaft 74*e*. The second sun gear 220 is positioned behind the first sun gear 196*e*.

The second planetary gear train 214 also includes a ring gear 222. The ring gear 222 is fixed to the lower unit 28*e* on the front side of the bearing carrier 78*e*. Each planet gear 216 carried by the carrier 210 rotates within and in mesh engagement with the ring gear 222.

The following elaborates on the previous description of the operation of the present transmission system 10*e*. To establish a forward drive condition, the actuator cam 112*e* moves the plunger 108*e* to slide the clutch 106*e* forward to engage the front gear 100*e* of the first transmission 96*e*. The front gear 100*e* drives the inner propulsion shaft 52*e* through the spline connection 166*e* between the clutch 106*e* and the inner propulsion shaft 52*e*. The inner propulsion shaft 52*e* drives the rear propeller 40*e* in a first rotational direction to assert a forward thrust.

The inner propulsion shaft 52*e* also drives the first sun gear 196*e* of the second transmission 132*e* which rotates with the inner propulsion shaft 52*e*. The sun gear 196*e* in turn drives the planet gears 200*e* of the first planetary gear train 209 which rotate in a rotational direction opposite to the first sun gear 196*e*. The planet gears 200*e*, which are fixed to the closure plate 192*e* about the sun gear 196*e*, drive the ring gear 204*e* in the same rotational direction of the planet gears 200*e*, and opposite to the rotational direction of the first sun gear. The carrier 210 thus rotates in a direction opposite to that of the inner propulsion shaft 52*e*.

The carrier 210 rotates within the fixed ring gear 222 of the second planetary gear train 214 which causes the planet gears 216 of the second planetary gear train 214 to rotate in a direction opposite to that in which the carrier 210 spins. The planet gears 216 in turn drive the second sun gear in the same direction that the carrier spins. As such, the outer propulsion shaft 74*e* rotates in a rotational direction opposite that of the inner propulsion shaft 52*e*. The outer propulsion shaft 74*e* thus drives the front propeller 38*e* to spin in a counter-rotational direction from the first propeller 40*c* and to assert a forward thrust.

The sizes of the gears in the first and second planetary gear trains 209, 214 desirably are selected such that the inner and outer propulsion shafts 52*e*, 74*e* rotate at about the same rotational speed. In this manner, the driving forces produced by the front and rear propellers 38*e*, 40*e* are substantially equal.

To establish the reverse drive condition, the actuator cam 112*e* moves the plunger 108*e* and clutch 106*e* rearward to positively engage the rear gear 102*e* of the first transmission 96*e*. So engaged the rear gear 102*e* drives the inner propulsion shaft 52*e* to spin the rear propeller 40*e* in a direction with asserts a reverse thrust to propel the watercraft 14*e* in reverse.

The inner propulsion shaft 52*e* also drives the outer propulsion shaft 74*e* via the second transmission 132*e*. The second transmission 132*e* reverses the directional spin input by the inner shaft 52*e* so as to drive the outer shaft 74*e* in an opposite rotational direction in the manner described above. The outer shaft 74*e* thus drives the front propeller 38*e* in an opposite direction to that of the rear propeller 40*e* under the reverse drive condition. The front propeller 40*e* asserts a reverse thrust when driven in reverse.

Figure 9:
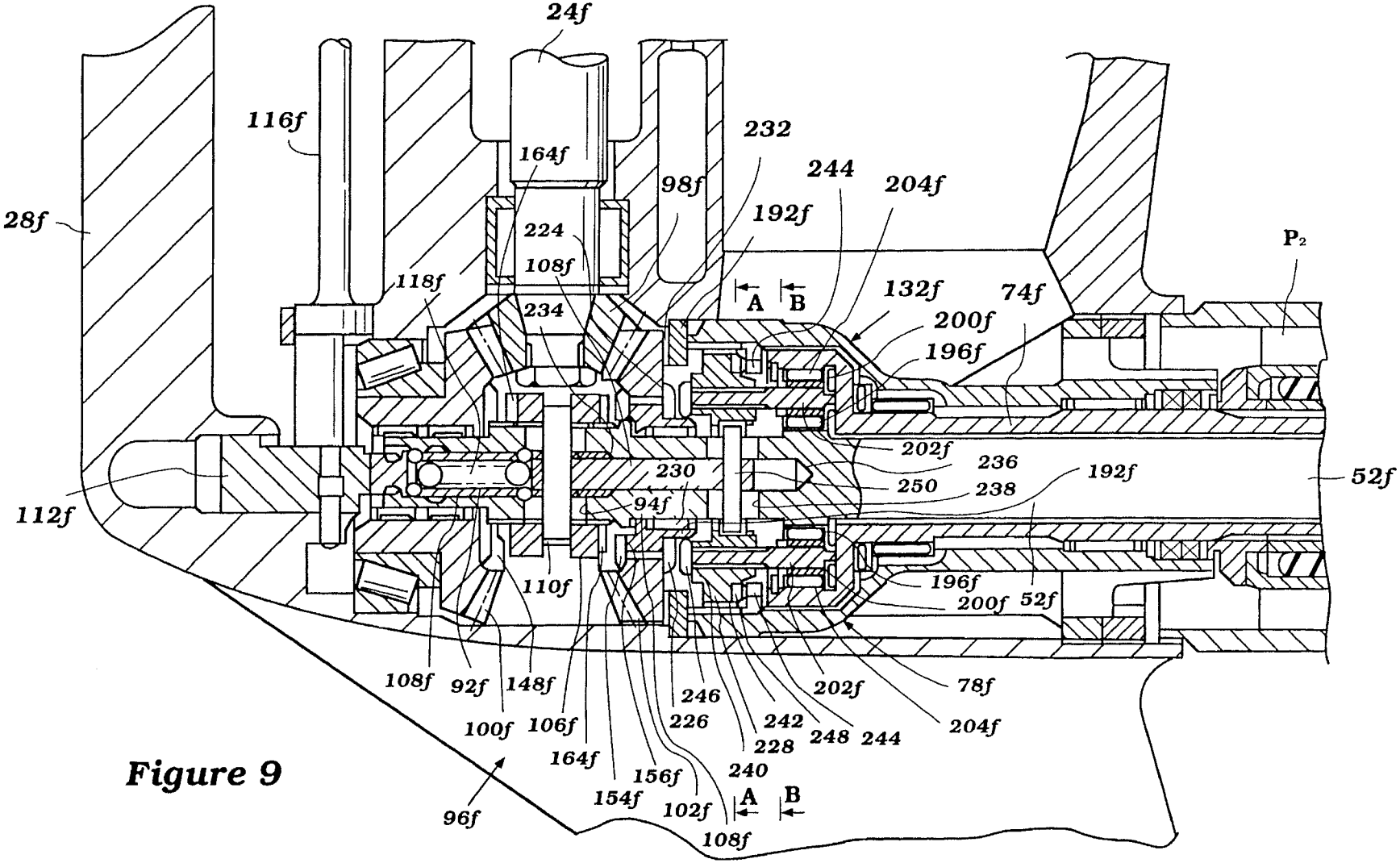
FIG. 9 is a sectional side elevational view of a transmission system of a lower unit of a marine outboard drive configured in accordance with yet a further preferred embodiment of the present invention.

FIG. 9 illustrates an additional preferred embodiment of the present transmission system with another configuration of the second transmission. Where appropriate, like numbers with a "f" suffix have been used to indicate like parts of the embodiments for ease of understanding.

As seen in FIG. 9, the first transmission 96*f* includes a pair of counter-rotating gears 100*f*, 102*2* driven by a drive gear 98*f*. A front clutch 106*f* is interposed between the driven gears 100*f*, 102*f* and selectively engages one of the driven gears 100*f*, 102*f* to establish a drive condition of an inner propulsion shaft 52*f* to which the clutch 106*f* is splined. An actuator cam 112*f* controls the operation of the clutch. The drive gear 98*f*, the driven front gear 100*f*, the front clutch 106*f* and the actuator mechanism 112*f* are substantially identical to the corresponding components of the embodiments described above. It therefore is understood that the preceding description of these components applies equally to these components in the present embodiment.

The rear gear 102*f* of the first transmission 96*f* includes front and rear annular engagement surface 152*e*, 224 which each carry a series of clutching teeth 154*f*, 226, respectively. The respective teeth 154, 226 are configured to positively engage the front clutch 106*f* of the first transmission 96*f* or a rear clutch 228 of the second transmission 132*f*, as discussed below.

The rear gear 102*f* of the includes a bearing hub 182*f* which is suitably journaled about the inner propulsion shaft 52*f* by a needle bearing assembly 230. The bearing assembly 230 rotatably supports the rear gear 102*f* in mesh engagement with the drive gear 98*f* of the first transmission 96*f*. A thrust bearing assembly 232 is interposed between the rear gear 102*f* and the retainer ring 192*f* to take the thrust loading on the rear gear 102*f*.

The bearing hub 192*f* of the rear gear 102*f* advantageously has a hollow shape with an inner bore that extends entirely through the gear from the front engagement surface 152*f* to the rear engagement surface 224*f*. The inner bore has a sufficiently sized diameter to receive the inner propulsion shaft 52*f* when assembled.

The plunger 108*f* of the present embodiment actuates a rear clutch 228 of the second transmission 132*f* in addition to the front clutch 106*f* of the first transmission 96*f*. For this purpose, the front end of the inner propulsion shaft 52*f* includes a longitudinal bore 92*f* with a stepped diameter formed by a first section and a smaller diameter second section. The first section of the bore 92*f* stems from the front end of the inner shaft to a transition surface 234 which is positioned on the rear side of the axis of the drive shaft 52*f*. The second section of the bore 92*f* stems from the transition surface 234 to a bottom surface 236 positioned to the rear of the second clutch 228.

As seen in FIG. 9, a front aperture 94*f* extends through the inner shaft 52*f*, transverse to the axis of the longitudinal bore 92*f*, at a position that is generally symmetrically between the driven gears 100*f*, 102*f*. The inner shaft 52*f* also includes a rear aperture 238 that extends transverse to the axis of the longitudinal bore 92*f* at a position behind the rear gear 102*f*.

The plunger 108*f* has a generally cylindrical rod shape and slides within the longitudinal bore 94*f* of the inner shaft 52*f* to actuate the clutches 106*f*, 228. In the illustrated embodiment, the plunger 108*f* comprises a hollow first segment which houses the above-described neutral detent mechanism 118*f*. The forward end of the plunger first segment is captured within the slot of the actuating cam 112*f*. The plunger 108*f* also includes a solid second segment. The plunger first segment is sized to slide within the first section of the longitudinal bore 92*f* at the front end of the propulsion shaft 52*f*. The plunger second segment is sized to slide within the second section of the longitudinal bore 92*f* of the inner propulsion shaft 52*f*. The second segment also is sized to fit inside the first segment.

The plunger segments together define a front hole that is positioned generally transverse to the longitudinal axis of the plunger 108*f*, and the rear plunger segment includes a rear hole that is likewise positioned generally transverse to the longitudinal axis of the plunger 108*f*. Each hole desirably is generally located symmetrically in relation to the corresponding apertures 94*f*, 238 of the inner propulsion shaft 52*f*.

The rear clutch 228 of the second transmission generally has a tubular shape to fit within the enlarged front end of the bearing carrier 78*f*. The rear clutch 228 includes an axial bore which extends between an annular front end plate 240 and a rear end of the clutch 228. The bore is sized to receive the inner propulsion shaft 52*f*. The clutch 228 also includes an annular rear end plate 242 formed at the radial exterior of the clutch 228 on the rear side.

The annular end plates 240, 242 of the rear clutch 228 are substantially coextensive in size with the annular rear engagement surface 224 of the rear gear 102*f* and an annular brake mechanism 244, respectively. The brake mechanism 244 is disposed within the enlarged front end of the bearing carrier 78*f*, and will be discussed in detail below. The annular end plates 240, 242 of the rear clutch 228 each support a plurality of clutching teeth 246, 248, respectively, which correspond in size and number with the teeth formed on the engagement surface 224 of the rear gear 102*f* and the brake mechanism 244, respectively.

Figure 10:
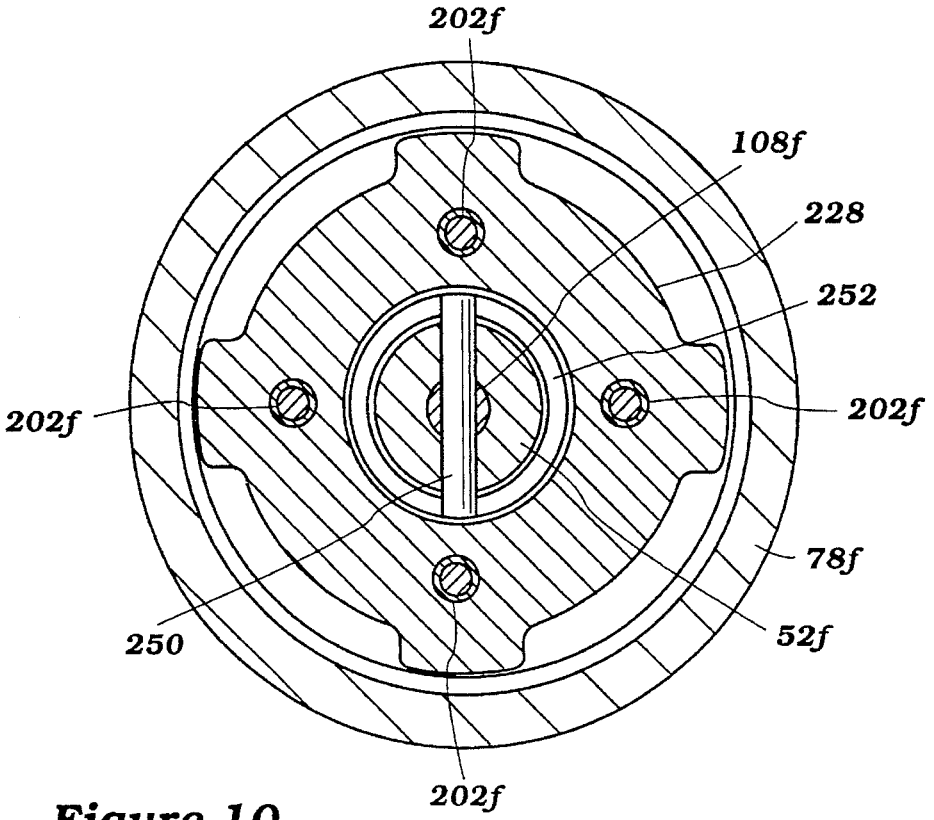
FIG. 10 is a cross-sectional view of a clutch of the transmission system of FIG. 9, taken along line A—A.

The rear clutch 228 also includes a counterbore. The counterbore is sized to receive a pin 250 which extends through the rear aperture 238 of the inner propulsion shaft 528 and through the rear hole of the plunger 108*f* when assembled. As best seen in FIG. 10, the ends of the pin 250 desirably are captured by an annular bushing 252. With reference back to FIG. 9, the bushing 252 and pin 250 are interposed between a pair of roller bearings. The assembly of the bushing 250 and is captured between a pair of washers and locked within the counterbore of the clutch 228 by a retaining ring. The roller bearings journal the bushing 252 and pin 250 assembly within the counterbore of the rear clutch 228. In this manner, the rear clutch 228 is coupled to the plunger 108*f* so as to allow the plunger 108*f* to rotate in one direction and the clutch 228 to rotate in an opposite direction, while the clutch 228 is drivingly connected to the outer propulsion shaft 74*f*.

The clutch also carries a plurality of support pins 202*f* which extend from the clutch 228 in the rearward direction. In the illustrated embodiment, as best seen in FIG. 10, the clutch 228 carries four support pins 204*f* that are equally spaced on the clutch body about the inner bore. A spline connection exists between each support pin 208*f* and the rear clutch 228 to allow the clutch 228 to slide forward and rearward over the support pins 202*f*, as well as rotatably drive the support pins 202*f*.

The rear clutch 228 is supported and suitably journalled within the enlarged front end of the bearing carrier 78*f*. The brake mechanism 244 also is positioned within the enlarged front end of the bearing carrier 78*f*, behind the rear clutch 228.

The brake mechanism 244 comprises a plurality of teeth fixed to the bearing carrier 78*f* inside the enlarged front end of the bearing carrier 78*f*. The teeth of the brake mechanism 244 desirably correspond with the rear teeth 248 of the rear clutch 228 in size, configuration and number. The brake mechanism teeth also are configured to engage the corresponding teeth of the rear clutch 228 without interfering with the operating of the rear clutch 228.

Figure 11:
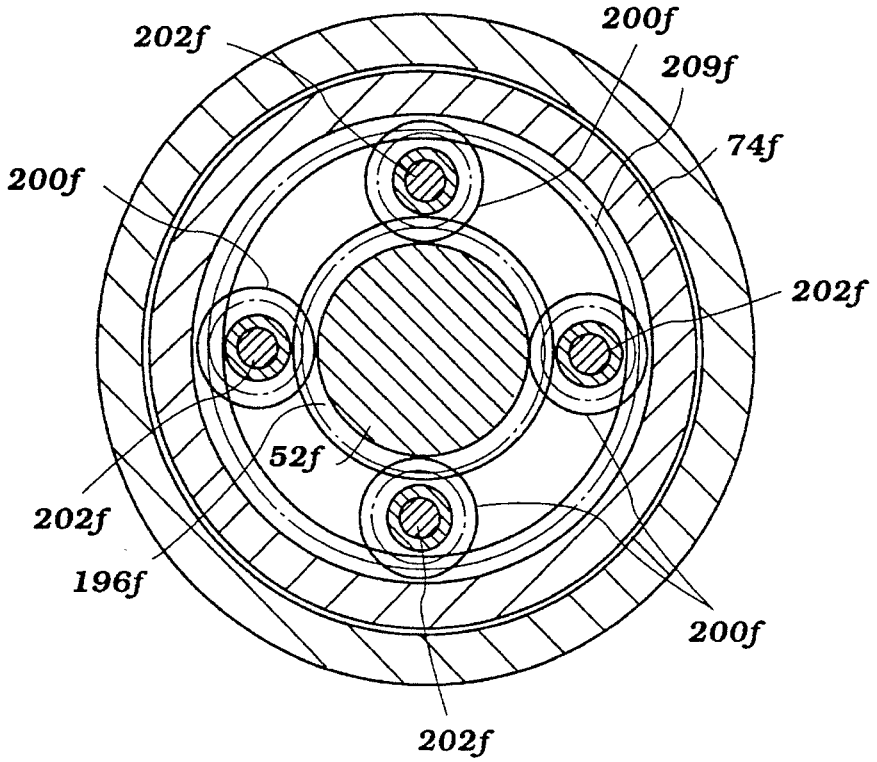
FIG. 11 is a cross-sectional view of a transmission of the transmission system of FIG. 9, taken along line B—B.

As seen in FIGS. 9 and 11, the second transmission also includes a planetary gear train. The inner propulsion shaft 52*f* carries a sun gear 196*f* which desirably is integrally formed on the exterior surface of the inner shaft 52*f*. In this manner, the sun gear 196*f* rotates with the inner propulsion shaft 52*f*.

The sun gear 196*f* drives a plurality of planet gears 200*f*. The support pins 202*f* carried by the rear clutch 228 support the planet gears 200*f* about the sun gear 196*f* and in mesh engagement with the sun gear 196*f*. Each planet gear 200*f* rotates about a support pin 202*f*. The support pins 202*f* and the associated planet gears 200*f* desirably are positioned about the sun gear 196*f* at equally spaced locations around the circumference of the sun gear 196*f*.

The planet gears in turn drive a ring gear 204*f* coupled to the outer propulsion shaft 52*f*. In the illustrated embodiment, the outer propulsion shaft 74*f* includes an enlarged front end which defines a large counterbore in which the second transmission 132*f* is positioned. The ring gear 204*f* is attached to or is integrally formed with the inner surface of the counterbore. In this manner, the outer propulsion shaft 74*f* rotates with the ring gear 204*f*.

The operation of the present transmission system 10*f* will now be described with primary reference to FIG. 9. FIG. 9 illustrates the front and rear clutches 106*f*, 228 of the first and second transmissions 96*f*, 132*f* in the neutral position. The detent mechanism 118*f* retains the clutches 106*f*, 228 in this position.

To establish a forward drive condition, the actuator cam 112*f* moves the plunger 108*f*, which in turn, slides the clutch 96*f* over the inner propulsion shaft 52*f* to engage one of the driven gears 100*f*, 102*f*. In the illustrated embodiment, forward motion of the plunger 108*f* establishes the forward drive condition by forcing the front clutch 106*f* into engagement with the front gear 100*f* with the corresponding clutching teeth 148*f*, 162*f* mating. So engaged, the front gear 100*f* drives the inner propulsion shaft 52*f* through the spline connection 118*f* between the clutch 106*f* and inner propulsion shaft 52*f*. The inner propulsion shaft 52*f* thus drives the rear propeller 40*f* in a first direction which asserts a forward thrust.

Forward motion of the plunger 108*f* also forces the rear clutch 228 into engagement with the rear gear 102*f* of the first transmission 96*f* with the corresponding clutching teeth 226, 246 mating. The rear gear 102*f* thus causes to rear clutch 228 and the carried support pins 202*f* to rotate in an opposite direction to the rotation of the inner propulsion shaft 52*f*. This motion of the support pins 202*f* causes the planet gears 200*f* to orbit about the sun gear 196*f*. The individual planet gears 200*f* also rotate about the corresponding support pins 202*f* in the same rotational direction that the rear clutch 228 spins.

The inner shaft 52*f* also rotates the sun gear 196*f* in an rotational direction opposite to that in which the individual planet gears 200*f* rotate. It should be noted that the sun gear 196*f* rotates at the same rotational speed as the clutch carrier 228 does, but in the opposite direction. The sun gear 196*f* and the clutch carrier 228 thus both drive the individual planet gears 200*f* about the respective support pins 202*f*.

The planet gears 200*f* in turn drive the ring gear 204*f* in the same rotational direction in which the planet gears 200*f* rotate about their support pins 202*f*. The outer propulsion shaft 74*f* rotates in a direction opposite to that of the inner propulsion shaft 52*f* with the ring gear 196*f* driven in this manner. The outer propulsion shaft 74*f* thus drives the front propeller 38*f* to spin in a counter-rotational direction from the rear propeller 40*f* and to assert a forward thrust.

The sizes of the gears in the planetary gear train of the second transmission 132*f* desirably are selected such that the inner and outer propulsion shafts 52*f*, 74*f* rotate at about the same rotational speed. In this manner, the driving forces produced by the front and rear propellers 38*f*, 40*f* are substantially balanced.

To establish the reverse drive condition in the illustrated embodiment, the actuator cam 112*f* moves the plunger 108*f* and front clutch 106*f* rearward to positively engage the rear gear 102*f* of the first transmission 96*f*. So engaged the rear gear 102*f* drives the inner propulsion shaft 52*f* to spin the rear propeller 40*f* in a direction with asserts a reverse thrust to propel the watercraft in reverse.

The plunger 108*f* also moves the rear clutch 228 of the second transmission 132*f* rearward to positively engage the brake mechanism 244 with the corresponding teeth mating. In this position, the rear clutch 228 is lock. That is, the brake mechanism 224 prevents the rear clutch 228 from rotating.

The inner propulsion shaft 52*f* drives the sun gear 196*f* of the second transmission 132*f* which rotates with the inner propulsion shaft 52*f*. The sun gear 196*f* in turn drives the planet gears 200*f* which rotate in a rotational direction opposite to the sun gear 196*f*. Each planet gear 200*f* rotates about the corresponding support pin 202*f* which are fixed in a stationary position with the rear clutch 228 locked. The planet gears 200*f* thus do not orbit the sun gear 204*f* when the illustrated transmission system 10*f* operates under the reverse drive condition.

The planet gears 200*f* drive the ring gear 204*f* in the same rotational direction as the planet gears rotate, which is opposite to the rotational direction of the sun gear 196*f*. The outer propulsion shaft 74*f* thus rotates in a direction opposite to that of the inner propulsion shaft 52*f*. The outer propulsion shaft 74*f* thus drives the front propeller 38*f* to spin in a counter-rotational direction from that of the first propeller 40*f* and to assert a reverse thrust.

Figure 12:
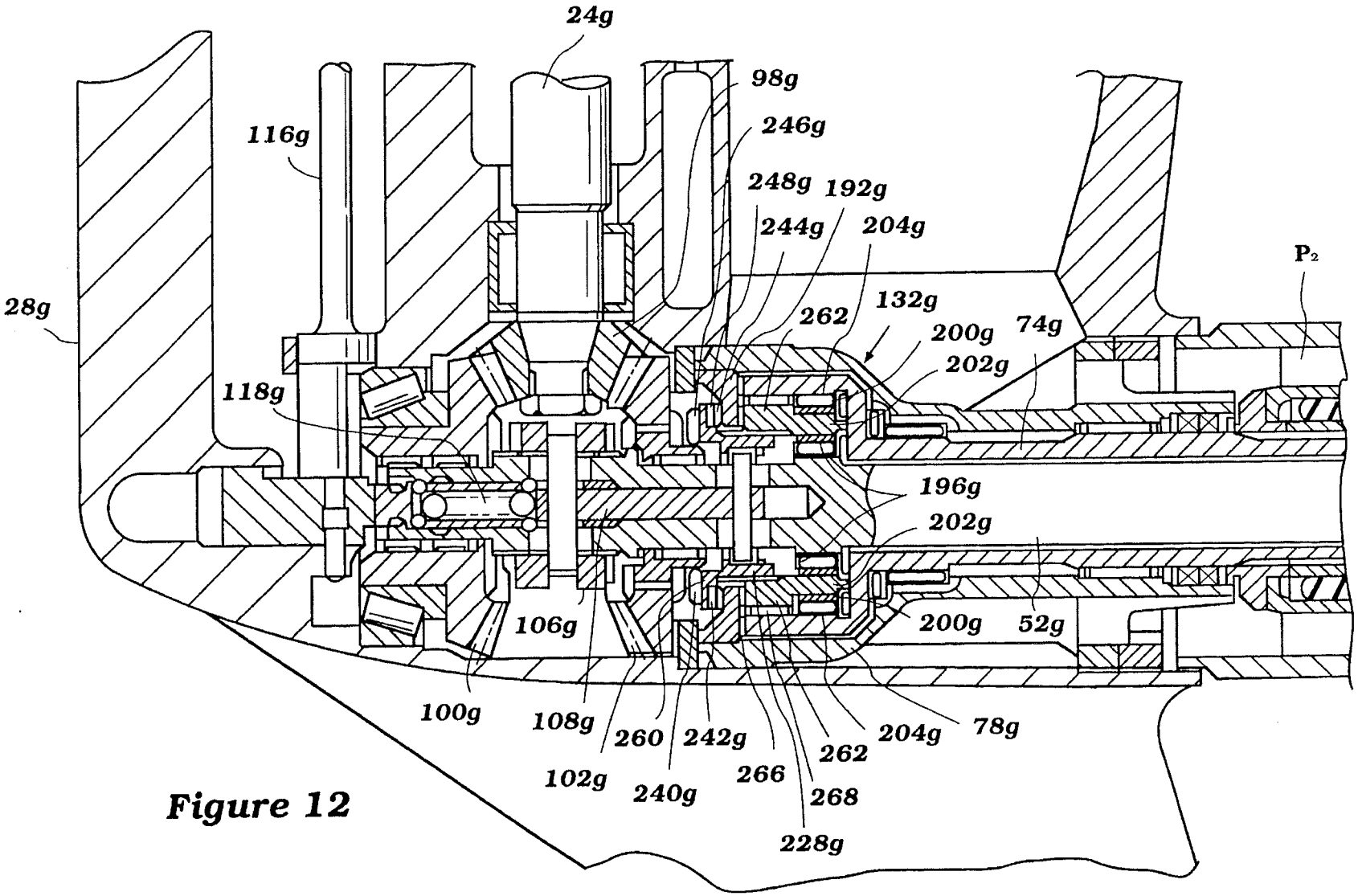
FIG. 12 is a sectional side elevational view of a transmission system of a lower unit of a marine outboard drive configured in accordance with yet an additional preferred embodiment of the present invention.

FIG. 12 illustrates a further preferred embodiment of the present transmission system which is substantially identical in form and operation to the transmission system described above in connection with FIGS. 9 through 11. Only the structure of the second clutch of the second transmission differs between the two embodiments. Accordingly, like reference numerals with a "g" suffix have been used to identify like components of the two embodiments for ease of understanding.

In the present embodiment of FIG. 12, the rear clutch 228*g* generally has a tubular shape with a flared front end 260. The flared end 260 defines the front engagement surface 240*g* of the clutch 228*g* on its front side and defines the rear engagement surface 242*g* of the clutch 228*g* on it rear side. The front and rear clutching teeth 246*g*, 249*g* extend from the respective engagement surfaces 240*g*, 242*g*.

The clutch 228*g* includes external splines on the exterior of the clutch tubular body behind the front end 260. The clutch 228*g* also includes an inner bore and a counterbore which receive the inner propulsion shaft 52*g* and the drive pin 250*g* and bushing assembly 252*g* which couple the rear clutch 228*g* to the plunger 108*g*, as described above.

A tubular carrier 262 includes an inner bore which receives a portion of the tubular body of the rear clutch 228*g*. Internal splines within the carrier mate with the external splines on the exterior of the rear clutch 228*g* to establish a drive connection while allowing the clutch 228*g* to slide within the inner bore of the carrier 262.

The carrier 262 also includes a plurality of support pins 202*g*. The support pins 202*g* extend from the rear side of the carrier 260 in a direction generally parallel to the axis of the inner propulsion shaft 52*g*. The support pins 202*g* are equally spaced on the carrier 262 about the inner bore.

A bearing assembly 264 supports the carrier 262 within an enlarged front end of the outer propulsion shaft 74*g* behind a retainer ring 192*g*. A bearing 266 journals the front end of the outer propulsion shaft 74*g* against the retainer ring 192*g*. The thrust bearing 266 takes a forward driving thrust from the outer propulsion shaft 74*g* so as to transfer the forward driving thrust from the front propeller 38*g* to the retainer ring 192*g* and the lower unit 28*g*. Rearward driving thrusts are transmitted to the bearing carrier 78*g* and lower unit housing 28*g* from a rear facing thrust shoulder of the enlarged front end of the outer propulsion shaft 74*g*, as described above.

The retainer ring 192*g* supports the clutch 228*g* within the enlarged front end of the bearing carrier 78*g*. A bearing assembly 268 suitably journals the rear clutch 228*g* to allow the clutch 228*g* to rotate relative to the retainer ring 192*g*. The retainer ring 192*g* also supports the brake mechanism 244*g* which is formed on a front facing surface of the retainer ring 192*g*, as understood from FIG. 12.

The second transmission 132*g* of the present embodiment also comprises a planetary gear train. The inner propulsion shaft 52*g* carries the sun gear 196*g* which rotates with the inner propulsion shaft 52*g*. The support pins 202*g* of the carrier 262 support the planet gears 200*g* about the sun gear 196*g* and in mesh engagement with the sun gear 196*g*. Each planet gear 200*g* rotates about the corresponding support pin 202*g*. The support pins 202*g* and the associated planet gears 200*g* desirably are positioned about the sun gear 196*g* at equally spaced locations around the circumference of the sun gear 196*g*.

The planet gears 200*g* in turn drive a ring gear 204*g* coupled to the outer propulsion shaft 74*g*. In the illustrated embodiment, the outer propulsion shaft includes an enlarged front end which defines a large counterbore in which the second transmission 132*g* is positioned. The ring gear 204*g* is attached to or is integrally formed with the inner surface of the counterbore. In this manner, the outer propulsion shaft 74*g* rotates with the ring gear 204*g*.

The present transmission system operates in a substantially identical manner to that of the transmission system of FIG. 9. The only differ in the operation of the two transmission system is that the clutch 228*g* drives the carrier 262 through the spline connection rather than directly carrying the support pins 202*g*. Otherwise, the operation is identical.

As common to all of the embodiments described above, both propeller rotate under both the forward and reverse drive conditions. As such, neither propeller blocks the thrust stream of the other under either drive condition, and the efficiency of the propulsion system when operated in reverse thus is improved over prior counter-rotational propeller system.

It also should be noted that the many of the above embodiments of the present transmission system are easily and readily incorporated into an existing outboard drive unit. In many cases, a substantial portion of the existing transmission can be incorporated into the first transmission of the present transmission system. The present transmission also is compatible with the existing transmission actuator system and drive shaft of the outboard drive. As such, incorporation of the present transmission system into an existing outboard drive requires replacement of fewer components, thus making the conversion process to a dual counter-rotational propulsion system more cost efficient.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. An outboard drive for a watercraft comprising a drive shaft adapted to be rotationally driven by a motor of the outboard drive and extending into a lower unit of the outboard drive, a first transmission which selectively couples said drive shaft to a first propulsion shaft which drives a first propulsion device external to the lower unit, and a second transmission provided between said first propulsion shaft and a second propulsion shaft, said second propulsion shaft driving a second propulsion device external to the lower unit, said second transmission configured to rotate said second propulsion shaft in a rotational direction opposite of the rotational direction that said first transmission rotatably drives said first propulsion shaft, said first and second transmissions being arranged within said lower unit of the outboard drive along an axis of said first propulsion shaft.

2. The outboard drive of claim 1, wherein said first propulsion shaft is an inner propulsion shaft and said second propulsion shaft is a hollow outer propulsion shaft which is positioned coaxially about said inner propulsion shaft.

3. The outboard drive of claim 1, wherein said first transmission is configured to selectively couple said first propulsion shaft to said drive shaft so as to establish a forward and a reverse drive condition in which said first propulsion shaft drives said first propulsion device under both said forward and reverse drive conditions, and said second transmission is configured to couple said second propulsion shaft to said first propulsion shaft to drive said second propulsion device under both said forward and reverse drive conditions.

4. The outboard drive of claim 1, wherein said first transmission comprises a pair of opposing driven gears driven by a drive gear which is connected to the drive shaft, and a clutching element interposed between said driven gears and configured to selectively engage one of said driven gears.

5. The outboard drive of claim 4, wherein said driven gears rotate in opposite rotational directions from each other, and said clutching element is drivingly connected to said first propulsion shaft so as to drive said first propulsion shaft in a rotational direction when said clutching element engages one of said driven gears, and to drive said first propulsion shaft in a reverse rotational direction when said clutching element engages the other of said driven gears.

6. The outboard drive of claim 1, wherein said first propulsion shaft carries a first gear of said second transmission.

7. The outboard drive of claim 6, wherein said first gear is a bevel gear of a gearset of said second transmission.

8. The outboard drive of claim 6, wherein said first gear is a sun gear of a planetary gear train of said second transmission.

9. The outboard drive of claim 1, wherein said second transmission comprises a gearset including a drive gear connected to said first propulsion shaft, a driven gear connected to said second propulsion shaft, and a pinion interposed between said drive gear and said driven gear.

10. The outboard drive of claim 9, wherein said gearset of said second transmission is configured such that said driven gear rotates in a rotational direction opposite that of said drive gear.

11. The outboard drive of claim 1, wherein said second transmission comprises a first planetary gear train comprising a sun gear connected to said first propulsion shaft, a plurality of planet gears positioned in mesh engagement about said sun gear, and a ring gear surrounding said plurality of planet gears and in mesh engagement with said planet gears, said ring gear coupled to said second propulsion shaft.

12. The outboard drive of claim 11, wherein each of said planet gears is supported by a fixed support pin in a manner in which said planet gear rotates about said support pin, and in a manner in which the corresponding support pin maintains the stationary position of said planet gear about said sun gear.

13. The outboard drive of claim 12, wherein said ring gear is carried by said second propulsion shaft.

14. The outboard drive of claim 11, wherein said second transmission additionally comprises a clutching element which selectively engages a rotating element of said first transmission so as to spin in a rotational direction opposite of said first propulsion shaft, and a plurality of support pins, each support pin supporting one of said plurality of planet gears, said clutching element being coupled to said support pins.

15. The outboard drive of claim 14, wherein said second propulsion shaft carries said ring gear.

16. The outboard drive of claim 11, wherein said second transmission is configured to drive said second propulsion shaft at a different rotational speed than said first propulsion shaft.

17. The outboard drive of claim 16, wherein said first and second propulsion devices each comprise a plurality of propeller blades, said propeller blades of said second propulsion device having a different pitch than the pitch of said propeller blades of said first propulsion device so as to compensate for the unbalanced driving force caused by the rotational speed differential between said first and second propulsion shafts.

18. The outboard drive of claim 1, wherein said first and second transmissions are arranged apart from the respective first and second propulsion devices.

19. The outboard drive of claim 1, wherein said first transmission is coupled to said first propulsion device through an intermediate shaft.

20. The outboard drive of claim 19, wherein said ring gear of said first planetary gear train is carried by a rotatable carrier, said carrier supporting a plurality of drive pins which support a plurality of planet gears of said second planetary gear train, said second planetary gear train further comprising a second sun gear connected to said second propulsion shaft with said planet gears of said second planetary gear train positioned in mesh engagement about said second sun gear, and a stationary ring gear which surrounds said planet gears of said second planetary gear train.

21. The outboard drive of claim 20, wherein said first and second planetary gear trains are configured such that said second transmission drives said second propulsion shaft at the same rotational speed at which said first propulsion shaft rotates.

22. The outboard drive of claim 11, wherein said ring gear is coupled to said second propulsion shaft through a second planetary gear train.

23. The outboard drive of claim 14, wherein said clutching element is coupled to said support pins in a manner rotating said support pins about said sun gear in a rotational direction opposite of the rotational direction which said first propulsion shaft drives said sun gear.

24. The propulsion system of claim 23, wherein said ring gear of said first planetary gear train is carried by a rotatable carrier, said carrier supporting a plurality of drive pins which support a plurality of planet gears of said second planetary gear train, said second planetary gear train further comprising a second sun gear connected to said second propulsion shaft with said planet gears of said second planetary gear train positioned in mesh engagement about said second sun gear, and a stationary ring gear which surrounds said planet gears of said second planetary gear train.

25. The propulsion system of claim 24, wherein said first and second planetary gear trains are configured such that said second transmission drives said second propulsion shaft at the same rotational speed at which said first propulsion shaft rotates.

26. An outboard drive for a watercraft comprising a drive shaft adapted to be rotationally driven by a motor of the outboard drive, a first transmission which selectively couples said drive shaft to a first shaft, and a second transmission coupling said first shaft to a second shaft and to a third shaft, said second transmission comprising a planetary gear train including a sun gear connected to said first shaft, a plurality of planet gears positioned in mesh engagement about said sun gear, and a ring gear surrounding said plurality of planet gears and in mesh engagement with said plane gears, said ring gear coupled to said second shaft, said third shaft carrying a plurality of support pins, each support pin supports one of said planet gears, said planet gears and said sun gear being arranged such that rotation of said sun gear causes said planet gears to orbit said sun gear in the same rotational direction as said sun gear so as to drive said third propulsion shaft in the same rotational direction as said first propulsion shaft.

27. The outboard drive of claim 26, wherein said ring gear is carried by said second propulsion shaft, said ring gear and said planet gears being arranged such that rotation of said planet gears about said support pins causes said ring gear to rotate in the same rotational direction as said planet gears rotate about the respected support pins so as to drive said second propulsion shaft in a rotational direction counter to that of said third propulsion shaft.

28. A propulsion system for a marine drive, said propulsion system being housed within a lower housing of the marine drive and selectively coupling a drive shaft with first and second propulsion shafts, said propulsion system comprising a first transmission which is driven by the drive shaft and is connected to the first propulsion shaft and which selectively couples the drive shaft to the first propulsion shaft so as to drive the first propulsion shaft in a first rotational direction, and a second transmission which is driven by the first propulsion shaft and is connected to the second propulsion shaft, said second transmission configured to drive the second propulsion shaft in a second counter-rotational direction which is opposite to said first rotational direction, said first and second transmission being disposed within said lower housing and arranged along a common axis of said first and second propulsion shafts.

29. The outboard drive of claim 28, wherein said second transmission comprises a gearset including a drive gear connected to said first propulsion shaft and a driven gear connected to said second propulsion shaft, and a pinion interposed between said drive gear and said driven gear.

30. The outboard drive of claim 29, wherein said gearset of said second transmission is configured such that said driven gear rotates in a rotational direction opposite that of said drive gear.

31. The propulsion system of claim 28, wherein said second transmission comprises a first planetary gear train comprising a sun gear connected to said first propulsion shaft, a plurality of planet gears positioned in mesh engagement about said sun gear, and a ring gear surrounding said plurality of planet gears and in mesh engagement with said planet gears, said ring gear coupled to said second propulsion shaft.

32. The propulsion system of claim 31, wherein each of said planet gears is supported by a fixed support pin in a manner in which said planet gear rotates about said support pin, and in a manner in which said support pin maintains the stationary position of said planet gear about said sun gear.

33. The propulsion system of claim 32, wherein said ring gear is carried by said second propulsion shaft.

34. The propulsion system drive of claim 31 additionally comprising a third propulsion shaft which carries a plurality of support pins, each support pin supports one of said planet gears, said planet gears and said sun gear being arranged such that rotation of said sun gear causes said planet gears to orbit said sun gear in the same rotational direction as said sun gear so as to drive said third propulsion shaft in the same rotational direction as said first propulsion shaft.

35. The propulsion system of claim 34, wherein said ring gear is carried by said second propulsion shaft, said ring gear and said planet gears being arranged such that rotation of said planet gears about said support pins causes said ring gear to rotate in the same rotational direction as said planet gears rotate about the respected support pins so as to drive said second propulsion shaft in a rotational direction counter to that of said third propulsion shaft.

36. The propulsion system of claim 31, wherein said second transmission additionally comprises a clutching element which selectively engages a rotating element of said first transmission so as to spin in a rotational direction opposite of said first propulsion shaft, and a plurality of support pins, each support pin supporting one of said plurality of planet gears, said clutching element being coupled to said support pins.

37. The propulsion system of claim 36, wherein said second propulsion shaft carries said ring gear.

38. The propulsion system of claim 28, wherein said first propulsion shaft is an inner propulsion shaft and said second propulsion shaft is a hollow outer propulsion shaft which is positioned coaxially about said inner propulsion shaft.

39. The outboard drive of claim 31, wherein said ring gear is coupled to said second propulsion shaft through a second planetary gear train.

40. The propulsion system of claim 36, wherein said clutching element is coupled to said support pins in a manner rotating said support pins about said sun gear in a rotational direction opposite of the rotational direction which said first propulsion shaft drives said sun gear.

41. The propulsion system of claim 28, wherein said first propulsion shaft drives a front propulsion device and said second propulsion shaft drives a rear propulsion device, and said first transmission is configured to selectively couple said propulsion shafts with the drive shaft of said outboard drive to establish a forward drive condition with both said front and rear propulsion devices being driven, and to selectively couple said propulsion shafts with said drive shaft to establish a reverse drive condition with both said front and rear propulsion devices being driven.

42. A propulsion system for a marine drive, said propulsion system being housed within a lower housing of the marine drive and selectively coupling a drive shaft with first and second propulsion shafts, said propulsion system comprising a transmission which is driven by the drive shaft and is connected to the first propulsion shaft and which selectively couples the drive shaft to the first propulsion shaft so as to drive the first propulsion shaft in a first rotational direction, and means for driving the second propulsion shaft in a second counter-rotational direction which is opposite to said first rotational direction, said means for driving the second propulsion shaft being driven by the first propulsion shaft and being disposed within said lower housing and arranged to operate about the same axis about which said transmission operates.

43. The propulsion system of claim 42, wherein said first and second propulsion shafts are positioned coaxially.

* * * * *